US006768370B2

(12) United States Patent
Takahashi et al.

(10) Patent No.: US 6,768,370 B2
(45) Date of Patent: Jul. 27, 2004

(54) INTERNAL VOLTAGE STEP-DOWN CIRCUIT

(75) Inventors: Hiroyuki Takahashi, Tokyo (JP); Nobumitsu Yano, Kanagawa (JP); Shinji Okumoto, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 67 days.

(21) Appl. No.: 10/282,500

(22) Filed: Oct. 29, 2002

(65) Prior Publication Data

US 2003/0081436 A1 May 1, 2003

(30) Foreign Application Priority Data

Oct. 31, 2001 (JP) ..... 2001-335554

(51) Int. Cl.[7] ..... G05F 1/10
(52) U.S. Cl. ..... 327/540
(58) Field of Search ..... 327/530, 538, 327/540, 541, 542; 323/273, 274, 282, 284, 351

(56) References Cited

U.S. PATENT DOCUMENTS 5,315,166 A * 5/1994 Arimoto ..... 327/537
5,568,083 A * 10/1996 Uchiyama et al. ..... 327/538
5,856,756 A * 1/1999 Sasahara et al. ..... 327/540
5,994,945 A * 11/1999 Wu et al. ..... 327/378
6,020,781 A * 2/2000 Fujioka ..... 327/541
6,111,395 A * 8/2000 Hirade et al. ..... 323/273
6,621,328 B2 * 9/2003 Koike et al. ..... 327/540

FOREIGN PATENT DOCUMENTS

JP 11-086542 3/1999

* cited by examiner

*Primary Examiner*—Adolf Berhane
(74) *Attorney, Agent, or Firm*—Darryl G. Walker; Bradley T. Sako

(57) ABSTRACT

A voltage step-down circuit (100) that may provide an internal voltage ($V_{INT}$) by reducing an external power source ($V_{DD}$) has been disclosed. A voltage step-down circuit (100) may include a voltage step-down portion (10) and a compensation current source portion (20). Voltage step-down portion (10) may compare a reference voltage ($V_{REF}$) with an internal voltage ($V_{INT}$) and control an output current ($I_0$) accordingly. An internal circuit (1) connected to receive internal voltage ($V_{INT}$) may transition from a standby state to an active state in accordance with an activation signal. Compensation current source portion (20) may provide a compensation current (Ic) when internal circuit (1) is in a standby state. In this way, voltage step-down portion (10) may be biased to provide sufficient output current ($I_0$) so that a response time may be improved and variations in internal voltage ($V_{INT}$) may be reduced.

30 Claims, 8 Drawing Sheets

INTERNAL VOLTAGE STEP-DOWN CIRCUIT

TECHNICAL FIELD

The present invention relates generally to an internal voltage step-down circuit and more particularly to an internal voltage step-down that may reduce an externally applied power source voltage to a predetermined internal voltage that may be provided to an internal circuit such as a semiconductor integrated circuit.

BACKGROUND OF THE INVENTION

In order to increase the capacity of a semiconductor storage device and/or decrease manufacturing costs, device elements (such as transistors) are made smaller or further miniaturized. However, as transistors, such as metal oxide semiconductor field effect transistors (MOSFETs), are made smaller, gate oxide films are reduced. Thus, the breakdown voltage of the gate oxide films are reduced and a power source voltage supplied to the semiconductor integrated circuit must be reduced. Therefore, an internal power source voltage step-down system is conventionally used to reduce an externally applied power source voltage to a predetermined internal source voltage. The internal source voltage is then supplied to internal circuits such as a semiconductor integrated circuit. Additionally, in order to reduce power consumption in a system, the externally applied power source can be reduced.

Referring now to FIG. 15, a circuit schematic diagram of a conventional internal voltage step-down circuit and an internal circuit is set forth.

In FIG. 15, a conventional internal voltage step-down circuit 10 receives an external power source voltage $V_{DD}$ and a reference voltage $V_{REF}$ and provides an internal voltage $V_{INT}$ to an internal circuit 1 through an internal power source line 13. Conventional internal voltage step-down circuit 10 includes a differential amplifier 11 and a driver p-channel MOSFET (hereinafter referred to as a PMOS transistor) 12. Differential amplifier 11 receives reference voltage $V_{REF}$ at an inverting input terminal (indicated with a minus–) and internal voltage $V_{INT}$ at a non-inverting input terminal (indicated with a plus +) and provides an output to a gate electrode of driver PMOS transistor 12. Driver PMOS transistor 12 has a source electrode connected to receive external power source voltage $V_{DD}$ and a drain connected to internal power source line 13. In this way, conventional internal voltage step-down circuit 10 provides internal voltage $V_{INT}$ at the drain of driver PMOS transistor 12. Internal voltage $V_{INT}$ is a stepped-down voltage from external power source voltage $V_{DD}$.

One or plural internal circuits 1 which consume an operating current I are connected to the internal power source line 13 to receive internal voltage $V_{INT}$ as a power source. In this way, internal voltage $V_{INT}$ is obtained by dividing external power source $V_{DD}$ by an impedance between the source and the drain of driver PMOS transistor 12 and an internal impedance of internal circuit 1.

In conventional voltage step-down circuit 10, differential amplifier 11 compares internal voltage $V_{INT}$ on internal power source line 13 with reference voltage $V_{REF}$. For example, when internal voltage $V_{INT}$ becomes lower than reference voltage $V_{REF}$, an output voltage of differential amplifier 11 is reduced. Thus, driver PMOS transistor 12 becomes more conductive to increase a current from external power source voltage $V_{DD}$. As a result, internal voltage $V_{INT}$ rises. On the other hand, when internal voltage $V_{INT}$ becomes higher than reference voltage $V_{REF}$, an output voltage of differential amplifier 11 is increased. Thus, driver PMOS transistor 12 becomes less conductive to reduce a current from external power source voltage $V_{DD}$. As a result, internal voltage $V_{INT}$ drops. Through this feedback operation, internal voltage $V_{INT}$ is controlled to be equal to reference voltage $V_{REF}$.

When memory access is not conducted, internal circuit 1 can be in an inactive state (standby mode). In this case, internal current I is a minute current on the order of a device leakage current of devices in internal circuit 1. Thus, a current $I_0$ output through driver transistor 12 is also a minute current on the order of the device leakage current of devices in internal circuit 1 and internal voltage $V_{INT}$ is controlled such that it is equal to reference voltage $V_{REF}$. On the other hand, when an active signal (such as an active signal pulse) is input to internal circuit 1 and internal circuit 1 is active, and the switching of devices in internal circuit 1 causes a higher internal current I. With a higher internal current I, the internal voltage $V_{INT}$ can be reduced. However, through the feedback operation of conventional step-down circuit 10, the control gate terminal of driver PMOS transistor 12 is pulled lower and the impedance of driver PMOS transistor 12 lowers. In this way, current $I_0$ flowing external power source voltage $V_{DD}$ to internal voltage $V_{INT}$ increases and internal voltage $V_{INT}$ is controlled to be equal to reference voltage $V_{REF}$.

However, when the potential of external power source voltage $V_{DD}$ is reduced, for example to reduce overall system power consumption, a potential difference between external power source voltage $V_{DD}$ and internal voltage $V_{INT}$ becomes small. Thus, the potential difference across driver PMOS transistor 12 is decreased and it becomes difficult to provide sufficient current $I_0$ to maintain internal voltage $V_{INT}$ to the same potential as to reference voltage $V_{REF}$. For example, when internal voltage $V_{INT}$ is 1.5 V and external power source voltage $V_{DD}$ is 1.8 V or less, a potential different between external power source voltage $V_{DD}$ and internal voltage $V_{INT}$ is 0.3 V or less, thus the potential difference between the source and the drain of driver PMOS transistor 12 is 0.3 V or less. With such a small potential difference between the source and the drain, driver PMOS transistor 12 may not provide sufficient current $I_0$ to maintain internal voltage $V_{INT}$ to the same potential as to reference voltage $V_{REF}$.

In particular, when an active signal is input and internal circuit 1 is in an active state, internal current I can rapidly increase. In this case, conventional voltage step-down circuit 1 has a delayed response before a reduced internal voltage $V_{INT}$ is restored to the potential of internal reference voltage $V_{REF}$. Alternatively, when internal circuit 1 is switched from an active (operating) state to a standby (non-operating) state, internal current I is reduced to the leakage current of devices in internal circuit 1, voltage conventional voltage step-down circuit 1 cannot respond quickly to reduce output current $I_0$ and overshoot occurs in the potential of internal voltage $V_{INT}$. Operation of internal circuit 1 can be affected by such a variation in an internal power source voltage such as internal voltage $V_{INT}$.

In order to improve the current capability of driver PMOS transistor 12 in conventional voltage step-down circuit 10, channel width W can be increased. When channel width W of driver PMOS transistor 12 increases, an operating current of differential amplifier 11 can be increased to increase amplification sensitivity and/or drive current. In this way, a response speed of conventional voltage step-down circuit 10 is increased to suppress variations in internal voltage $V_{INT}$ providing an internal power source. However, such an approach increases power consumption and/or the chip area occupied by conventional voltage step-down circuit 10.

In a dynamic random access memory (DRAM), a large current amount is consumed over a short period of time during a sense operation. When a conventional internal power source voltage step-down circuit is used to convert an external power source voltage into a predetermined internal voltage to provide a power supply for sensing operations or the like in a DRAM, a technique has been employed in which a driver PMOS transistor is automatically turned on in response to a trigger signal in anticipation of the large current demand. For example, in Japanese Patent Application laid-open 11-086542 A (JP 11-086542 A), an auxiliary current is provided from the external power source voltage node to the internal voltage node by causing a driver PMOS transistor to be turned on for a predetermined period in response to a trigger signal in the case where a large current is consumed in a sense operation or the like.

According to the technique described in JP 11-086542 A, when the internal circuit consumes a large current, a delay in the response of a conventional internal power source voltage step-down circuit to provide current to the internal voltage supply node is compensated for by providing current from the external power source voltage node through an auxiliary driver PMOS transistor. In this way, a reduction (undershoot) in internal voltage $V_{INT}$ may be prevented.

In the technique described in JP 11-086542 A, the auxiliary driver PMOS transistor is turned on for a predetermined period from a time when an active signal for conducting the sense operation is provided to the internal circuit (DRAM or the like). Thus, a current is provided from the external power source voltage node. However, when the current in provided from the external power source voltage through driver PMOS transistor, internal voltage $V_{INT}$ may vary (rise in this case) which may effect circuit operations.

For example, in a configuration as illustrated in FIG. 15, the operating current I consumed in internal circuit 1 can vary during a period that an active signal pulse is provided to internal circuit 1. However, in the technique described above in JP 11-086542 A, a current provided from the external power source voltage node to the internal voltage supply node through a driver PMOS transistor for a predetermined period after the trigger signal is receive may be a constant current. Thus, it is difficult to match the current consumed by internal circuit 1 with the current provided by the extra driver PMOS transistor which may further contribute to variations of internal voltage $V_{INT}$.

Generally, when internal circuit 1 switches to an active state, a time delay may occur before operating current I is drawn from internal voltage supply line 13. Thus, a consumption current on internal voltage supply line 13 may not change for the time delay from a time when an active signal pulse is provided. Thus, if the extra driver PMOS transistor as disclosed in JP 11-086542 A is turned on during this period to provide a current from an external power source, an excessive current may be provided and internal voltage $V_{INT}$ may increase.

Also, according to the technique described in JP 11-086542 A, at a time the extra PMOS transistor is turned off, internal circuit 1 is in an active state. Subsequently, when internal circuit 1 transitions from an active state to a standby state, current I may be greatly reduced. However, the conventional voltage step-down circuit may not be able to rapidly switch from providing a large current $I_0$ to provide a small current $I_0$. In this way, variations in internal voltage $V_{INT}$ may not be suppressed.

In view of the above discussion, it would be desirable to provide a means for suppressing a variation in an internal voltage which may be caused by a variation in current consumed by an internal circuit. It would also be desirable to suppress an internal voltage without providing an excessive current to an internal voltage supply line. It would also be desirable to suppress variations of an internal voltage when an internal circuit switches from an active state to a standby state which may cause a current consumed by the internal circuit to be greatly and rapidly reduced.

SUMMARY OF THE INVENTION

According to the present embodiments, a voltage step-down circuit that may provide an internal voltage by reducing an external power source is disclosed. A voltage step-down circuit may include a voltage step-down portion and a compensation current source portion. A voltage step-down portion may compare a reference voltage with an internal voltage and control an output current accordingly. An internal circuit connected to receive internal voltage may transition from a standby state to an active state in accordance with an activation signal. A compensation current source portion may provide a compensation current when internal circuit is in a standby state. In this way, voltage step-down portion may be biased to provide sufficient output current so that a response time may be improved and variations in internal voltage may be reduced.

According to one aspect of the embodiments, a voltage step-down circuit may include a voltage step-down portion and a compensation current portion. A voltage step-down portion may compare a reference voltage with an internal voltage and may generate the internal voltage by reducing an external power source voltage in accordance with a comparison result. An internal voltage supply line may receive the internal voltage and may provide power to an internal circuit. The internal circuit may have an active state and an inactive state. A compensation current source portion may be connected to the internal voltage supply line and may provide a compensation current for compensating an output current of the voltage step-down portion at a time when the internal circuit is in the inactive state.

According to another aspect of the embodiments, a voltage step-down circuit may include a voltage step-down portion. A voltage step-down portion may compare a reference voltage with an internal voltage and may generate the internal voltage by reducing an external power source voltage in accordance with a comparison result. An internal voltage supply line may receive the internal voltage and may provide power to an internal circuit. The internal circuit may have an active state and an inactive state. The voltage step-down portion may include a differential amplifier, an amplifier, and a driver transistor. The differential amplifier may be connected to receive the reference voltage at a first input terminal and the internal voltage at a second input terminal and may provide the comparison result. The amplifier may receive the comparison result and may provide an amplifier output. Power to the amplifier may be provided by the internal voltage supply line. The driver transistor may provide a current path for an output current between the external power source voltage and the internal voltage supply line and may have a driver transistor control terminal connected to receive the amplifier output. The amplifier may provide a compensation current for compensating the output current of the voltage step-down portion at a time when the internal circuit is in the inactive state.

According to another aspect of the embodiments, a voltage step-down circuit may include a voltage step-down portion. A voltage step-down portion may compare a reference voltage with an internal voltage and may generate the internal voltage by reducing an external power source voltage in accordance with a comparison result. An internal voltage supply line may receive the internal voltage and may provide power to an internal circuit. The internal circuit may have an active state and an inactive state. The voltage step-down portion may include a voltage dividing circuit, a differential amplifier, an amplifier, and a driver transistor. The voltage dividing circuit may provide a voltage dividing output by dividing the internal voltage. The differential amplifier may be connected to receive the reference voltage at a first input terminal and the voltage dividing output at a second input terminal and may provide the comparison result. The amplifier may receive the comparison result and may provide an amplifier output. Power to the amplifier may be provided by the internal voltage supply line. The driver transistor may provide a current path for an output current between the external power source voltage and the internal voltage supply line and may have a driver transistor control terminal connected to receive the amplifier output. The voltage dividing circuit, the differential amplifier, and the amplifier may provide a compensation current for compensating the output current of the voltage step-down portion at a time when the internal circuit is in the inactive state.

According to another aspect of the embodiments, a voltage step-down circuit may include a voltage step-down portion. A voltage step-down portion may compare a reference voltage with an internal voltage and may generate the internal voltage by reducing an external power source voltage in accordance with a comparison result. An internal voltage supply line may receive the internal voltage and may provide power to an internal circuit. The internal circuit may have an active state and an inactive state. A functional circuit may be connected to receive power from the internal voltage supply line and may provide a compensation current for compensating an output current of the voltage step-down portion at a time when the internal circuit is in the inactive state.

According to another aspect of the embodiments, a voltage step-down circuit may include a voltage step-down portion. A voltage step-down portion may compare a reference voltage with an internal voltage and may generate the internal voltage by reducing an external power source voltage in accordance with a comparison result. An internal voltage supply line may receive the internal voltage and may provide power to an internal circuit. The internal circuit may have an active state and an inactive state. A device parameter of the internal circuit may be set so that an internal circuit leakage current consumed from the internal voltage supply line may be at least a predetermined value at a time when the internal circuit is in the inactive state.

According to another aspect of the embodiments, the voltage step-down portion may include a differential amplifier and a driver transistor. The differential amplifier may receive the reference voltage at a first input terminal and the internal voltage at a second input terminal and may provide the comparison result. The driver transistor may provide a current path for the output current between the external power source voltage and the internal voltage supply line and may receive the comparison result at a driver transistor control terminal.

According to another aspect of the embodiments, the driver transistor may be a p-type insulated gate field effect transistor (IGFET). The driver transistor may have a driver transistor source connected to receive the external power source voltage and a driver transistor drain connected to the internal voltage supply line.

According to another aspect of the embodiments, the compensation current may be essentially disabled when the internal circuit is in the active state and a consumption current of the internal circuit is increased as compared to when the internal circuit is in the inactive state.

According to another aspect of the embodiments, the compensation current source portion may include a n-type IGFET and a bias voltage generating circuit. The n-type IGFET may provide a controllable current path between the internal voltage supply line and a ground potential. The bias voltage generating circuit may provide a bias voltage to a control gate of the n-type IGFET for setting the compensation current.

According to another aspect of the embodiments, the compensation current source portion may include a first n-type IGFET, a second n-type IGFET, and a bias voltage generating circuit. The first n-type IGFET may have a first controllable impedance path connected in series with a second controllable impedance path of a second n-type IGFET between the internal voltage supply line and a ground potential. A control gate of the first n-type IGFET may receive a control signal for inhibiting the compensation current when the internal circuit is in the active state and a consumption current of the internal circuit is increased as compared to when the internal circuit is in the inactive state. The bias voltage generating circuit may provide a bias voltage to a control gate of the second n-type IGFET for setting the compensation current.

According to another aspect of the embodiments, the compensation current source portion may include a first n-type IGFET and a second n-type IGFET. The first n-type IGFET may be connected in series with a first programmable device between the internal voltage supply line and a ground potential. The second n-type IGFET may be connected in series with a second programmable device between the internal voltage supply line and the ground potential.

According to another aspect of the embodiments, the compensation current source portion may include a first voltage dividing circuit, a first inverting amplifier, and a n-type IGFET. The first voltage dividing circuit may be connected between the internal voltage supply line and a ground potential and may provide a first voltage dividing output. The first inverting amplifier may receive the first voltage dividing output and may provide a first inverting amplifier output. The n-type IGFET may provide a controllable impedance path between the internal voltage supply line and the ground potential and may receive the first inverting amplifier output at a control gate.

According to another aspect of the embodiments, the first inverting amplifier may include a first n-type IGFET and a second n-type IGFET. The first n-type IGFET may have a source connected to the ground potential, a drain connected to the first inverting amplifier output, and a gate connected to receive the first voltage dividing output. The second n-type IGFET may have a source connected to the first inverting amplifier output and a drain and a gate connected to the internal voltage supply line.

According to another aspect of the embodiments, the first voltage dividing output is set to a potential close to a threshold voltage of a n-type IGFET.

According to another aspect of the embodiments, the compensation current source portion may include a second voltage dividing circuit, a second inverting amplifier, and a p-type IGFET. The second voltage dividing circuit may be connected between the internal voltage supply line and a ground potential and may provide a second voltage dividing output. The second inverting amplifier may receive the second voltage dividing output and may provide a second inverting amplifier output. The p-type IGFET may provide a controllable impedance path between the internal voltage supply line and the ground potential and may receive the second inverting amplifier output at a control gate.

According to another aspect of the embodiments, the first inverting amplifier may include a first p-type IGFET and a second p-type IGFET. The first p-type IGFET may have a source connected to the internal voltage supply line, a drain connected to the second inverting amplifier output, and a gate connected to receive the second voltage dividing output. The second p-type IGFET may have a source connected to the first inverting amplifier output and a drain and a gate connected to the ground potential.

According to another aspect of the embodiments, the second voltage dividing output is set to a potential close to a threshold voltage of a p-type IGFET below the internal voltage.

According to another aspect of the embodiments, the amplifier may include a p-type IGFET and a n-type IGFET. The p-type IGFET may have a source connected to the internal voltage supply line, a gate connected to receive the comparison result, and a drain connected to the amplifier output. The n-type IGFET may have a source connected to the ground potential and a drain connected to the amplifier output.

According to another aspect of the embodiments, the amplifier may include a p-type load IGFET and a n-type IGFET. The p-type load IGFET may have a source connected to the internal voltage supply line and a drain connected to the amplifier output. The n-type IGFET may have a source connected to the ground potential, a drain connected to the amplifier output, and a gate connected to receive the comparison result.

DETAILED DESCRIPTION OF THE EMBODIMENTS

Various embodiments of the present invention will now be described in detail with reference to a number of drawings.

Figure 1:
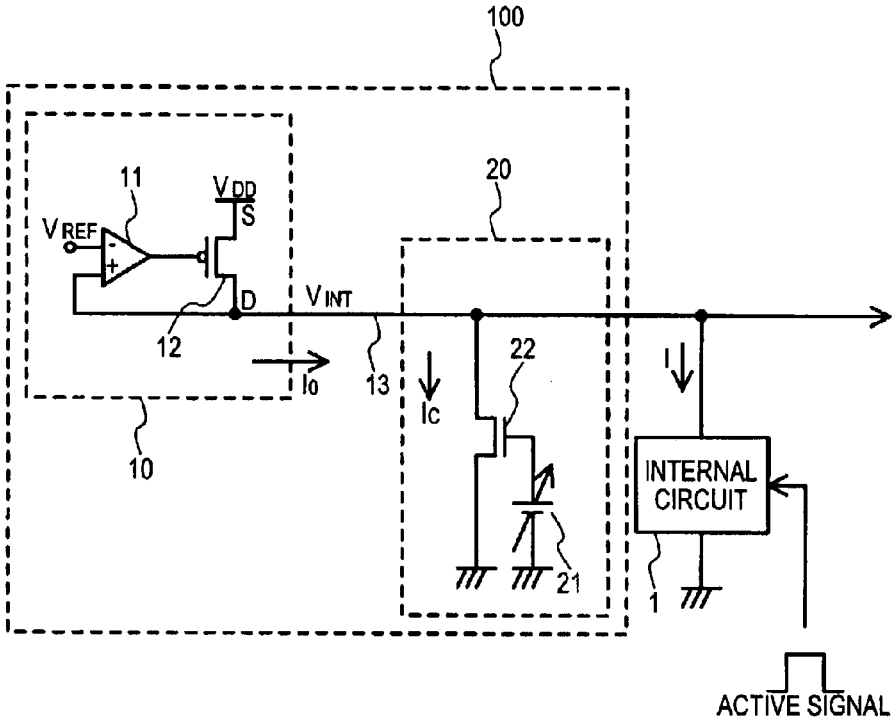
FIG. 1 is a circuit schematic diagram of a voltage step-down circuit and an internal circuit according to an embodiment.

Referring now to FIG. 1, a circuit schematic diagram of a voltage step-down circuit 100 and an internal circuit 1 according to an embodiment is set forth.

Voltage step-down circuit 100 may include a voltage step-down portion 10 and a compensation current source portion 20. Voltage step-down circuit 100 may receive an external power source voltage $V_{DD}$ and a reference voltage $V_{REF}$ and may provide an internal voltage $V_{INT}$ to an internal circuit 1 through an internal power source line 13.

Voltage step-down portion 10 may include a differential amplifier 11 and a driver transistor 12. Driver transistor 12 may be a driver p-type insulated gate field effect transistor (p-type IGFET). Differential amplifier 11 may receive reference voltage $V_{REF}$ at an inverting input terminal (indicated with a minus –) and internal voltage $V_{INT}$ at a non-inverting input terminal (indicated with a plus +) and may provide an output to a gate electrode of driver p-type IGFET 12. Driver p-type IGFET 12 may have a source electrode connected to receive external power source voltage $V_{DD}$ and a drain connected to internal power source line 13. In this way, internal voltage step-down portion 10 may provide internal voltage $V_{INT}$ at the drain of driver p-type IGFET 12. Internal voltage $V_{INT}$ may be stepped-down voltage from external power source voltage $V_{DD}$.

One or plural internal circuits 1 which may consume an operating current I may be connected to the internal power source line 13 to receive internal voltage $V_{INT}$ as a power source. Internal circuit 1 may be switched between an active state and an inactive state in response to an active signal. Internal circuit 1 may consume an operating current when in an active state and a minute leak current when in an inactive state. The minute leak current may be determined by leakage current of devices (such as IGFETs) included in internal circuit 1.

Compensation current source portion 20 may be connected between internal voltage supply line 13 and a reference potential. Compensation current source portion 20 may cause a compensation current Ic to be drawn from internal voltage supply line 13 to a reference potential (such as ground). In this way, an output current $I_0$ provided from voltage step-down portion 10 may be at least a predetermined value even when internal circuit 1 is in an inactive state.

Compensation current source portion 20 may include an n-type IGFET 22 and a bias voltage generating circuit 21. Bias voltage generating circuit 21 may generate a fixed or variable bias voltage. N-type IGFET 22 may have a drain connected to internal voltage power supply line 13, a source connected to reference voltage (ground), and a gate connected to receive a bias voltage from bias voltage generating circuit 21. In this way, bias voltage generating circuit 21 may set a compensation current Ic by controlling an impedance path through n-type IGFET 22 from internal voltage supply line 13 and a reference voltage (such as ground).

Figure 2:
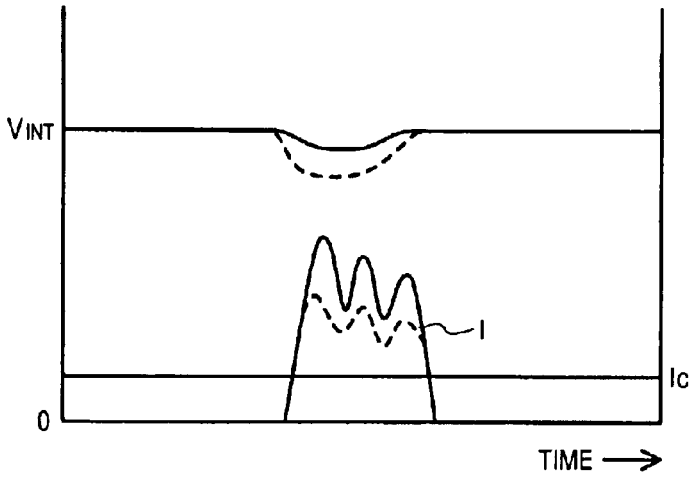
FIG. 2 is a graph illustrating an operation of a voltage step down circuit according to an embodiment.

The operation of voltage step-down circuit 100 will now be described with reference to FIG. 1 in conjunction with FIG. 2. FIG. 2 is a graph illustrating an operation of voltage step down circuit 100 according to an embodiment. In FIG. 2, solid lines indicate characteristics when voltage step-down circuit 100 according to an embodiment is used and dashed lines indicate characteristics when a conventional voltage step-down circuit is used.

Figure 15:
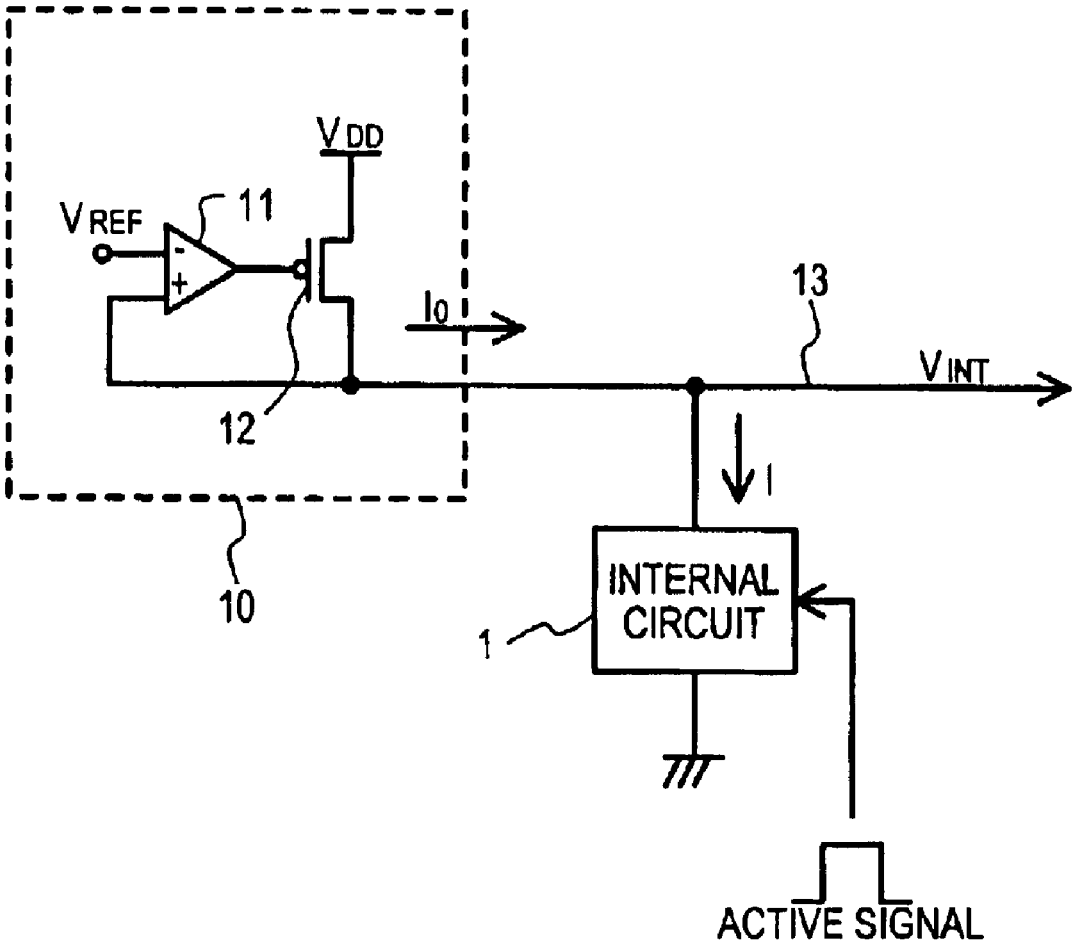
FIG. 15 (BACKGROUND ART)
FIG. 15 is a circuit schematic diagram of a conventional internal voltage step-down circuit and an internal circuit.

When a conventional voltage step-down circuit is used without a compensation current source portion 20, current $I_0$ provided from conventional voltage step-down circuit is on the order of a leakage current of devices in internal circuit 1 when internal circuit 1 is in an inactive state. Under this condition, an operating point of a driver PMOS transistor is near cutoff and the conventional voltage step-down circuit is operated in a state in which a loop gain thereof is low. In such a state, when internal circuit 1 transitions from the inactive state to the active state, a current I of internal circuit 1 is rapidly increased as illustrated with a dashed line in FIG. 2. However, the conventional voltage step-down circuit (as illustrated in FIG. 15) cannot immediately respond to the change because the loop gain is low. Therefore, internal voltage $V_{INT}$ (as illustrated with a dashed line in FIG. 2) provided by the conventional voltage step-down circuit varies greatly and suffers from undershoot.

On the other hand, when compensation current source portion 20 according to an embodiment is included in a voltage step-down circuit 100, even when internal circuit 1 is in the inactive state, current $I_0$ provided from a voltage step-down portion 10 may be a sum of a leakage current of devices in internal circuit 1 and a compensation current Ic from compensation current source portion 20. In this way, the operating point of driver p-type IGFET 12 may be within an active region. Thus, voltage step-down circuit portion 10 may operate in a state in which a loop gain may be sufficiently high.

By operating in such a state, even when an active signal is provided to internal circuit 1 and internal circuit 1 transitions causing current I to rapidly increase, voltage step down circuit portion 10 may essentially immediately respond to the changed conditions because a loop gain thereof is high. Thus, a variation in internal voltage $V_{INT}$ may be suppressed to be relatively small as indicated by the solid line shown in FIG. 2.

Also illustrated in FIG. 2 is a solid line showing compensation current Ic superimposed on current I of internal circuit 1 to illustrate current which may be provided by voltage step-down circuit portion 10.

Figure 3:
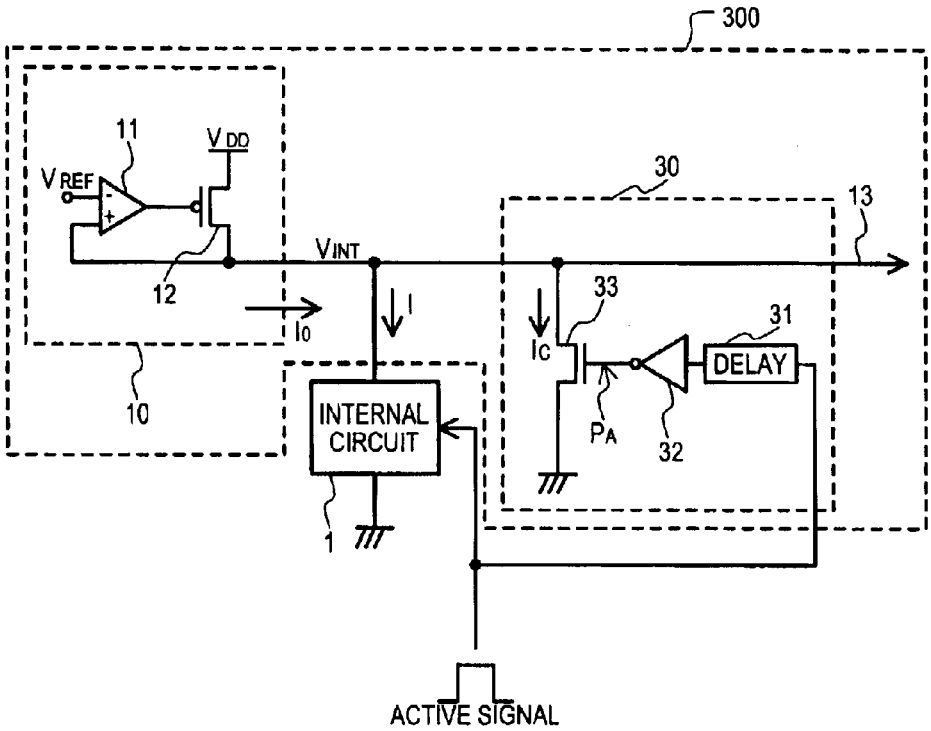
FIG. 3 is a circuit schematic diagram of a voltage step-down circuit and an internal circuit according to an embodiment.

Referring now to FIG. 3, a circuit schematic diagram of voltage step-down circuit 300 and an internal circuit 1 according to an embodiment is set forth. Voltage step-down circuit 300 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step down circuit 300 may include a compensation current source portion 30. Compensation current source portion 30 may be connected between internal voltage supply line 13 and a ground potential terminal and may provide internal power source stabilization. Compensation current source portion 30 may be located in the vicinity of internal circuit 1. Compensation current source portion 30 may be turned off during a period for which internal circuit 1 is in an active state and current I consumed by internal circuit 1 is increased. Compensation current source portion 30 may be turned on to produce a compensation current Ic when internal circuit 1 is in an inactive state and current I consumed by internal circuit 1 is on the order of a leakage current of devices in internal circuit 1.

Compensation current source portion 30 may include a delay circuit 31, an inverter 32, and a n-type IGFET 33. Delay circuit 31 may delay an active signal ACTIVE SIGNAL to provide an output to an input of inverter 32. Inverter 32 may provide a signal $P_A$ to a gate of n-type IGFET 33. N-type IGFET 33 may have a drain connected to internal voltage supply line 13 and a source connected to a ground potential terminal.

Delay circuit 31 may be provide a delay such that an operation delay of internal circuit 1 may be essentially equal to an operation delay of compensation current source portion 30 with respect to active signal ACTIVE SIGNAL. However, when a difference between operation delays with respect to active signal ACTIVE SIGNAL is essentially nonexistent without delay circuit 31, the delay circuit 31 may be omitted. In addition, when active signal ACTIVE SIGNAL is a negative pulse, inverter 32 may be omitted.

Figure 4:
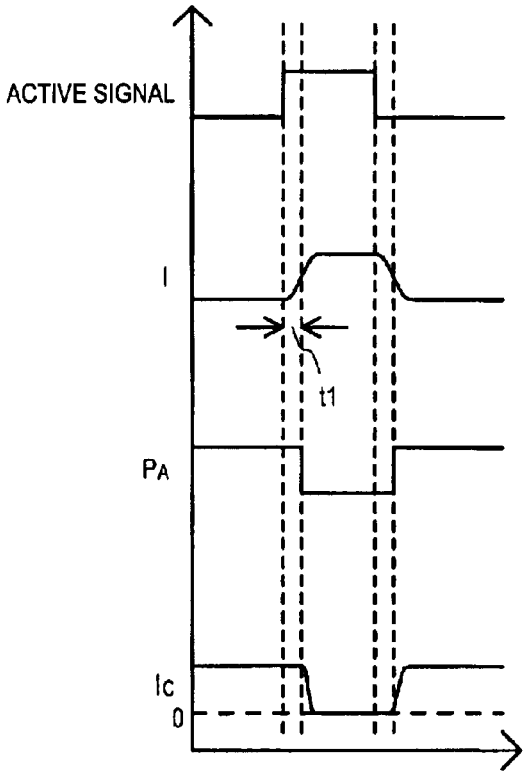
FIG. 4 is a timing diagram illustrating the operation of a voltage step-down circuit and an internal circuit according to an embodiment
Figure 5:
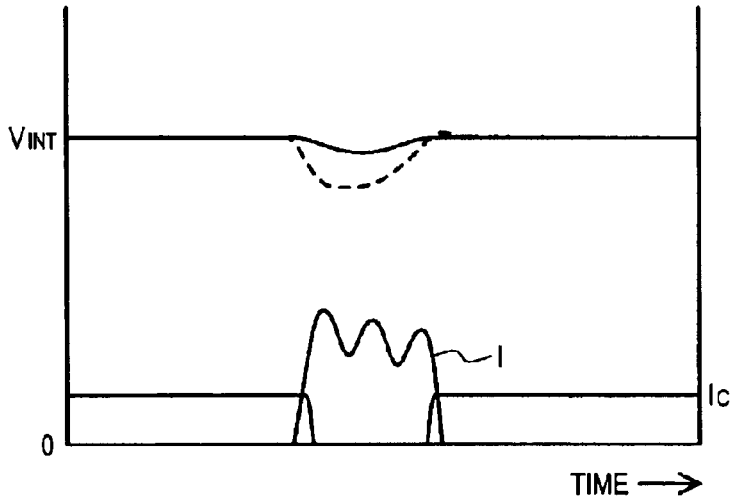
FIG. 5 is a graph illustrating an operation of a voltage step down circuit according to an embodiment.

The operation of voltage step-down circuit 300 will now be described with reference to FIG. 3 in conjunction with FIGS. 4 and 5. FIG. 4 is a timing diagram illustrating the operation of voltage step-down circuit 300 and internal circuit 1 of FIG. 3 according to an embodiment. FIG. 4 illustrates waveforms for active signal ACTIVE SIGNAL, current I in internal circuit 1, signal $P_A$, and compensation current Ic. FIG. 5 is a graph illustrating an operation of voltage step down circuit 300 according to an embodiment. In FIG. 5, solid lines indicate characteristics when voltage step-down circuit 300 according to an embodiment is used and dashed lines indicate characteristics when a conventional voltage step-down circuit is used.

When internal circuit 1 is in an inactive state (active signal ACTIVE SIGNAL is low), current I consumed by internal circuit 1 may only be minute in accordance with leakage current of devices in internal circuit 1. Because active signal ACTIVE SIGNAL is low at this time, signal $P_A$ provided by inverter 32 may be high and n-type IGFET 33 in compensation current source portion 30 may be turned on. With n-type IGFET 33 turned on compensation current Ic may flow through n-type IGFET 33 so that p-type IGFET 12 in voltage step-down portion 10 may be turned on and may provide a current $I_0$ essentially equal to compensation current Ic plus a leakage current of internal circuit 1.

In such a state, when active signal ACTIVE SIGNAL provided to internal circuit 1 becomes high, internal circuit 1 may transition to an active state and current I consumed by internal circuit may rapidly increase. Timing of the increase in current I may be delayed by a period t1 from a time when active signal ACTIVE SIGNAL transitions to a logic high due to an operation delay of internal circuit 1.

Active signal ACTIVE SIGNAL may also be provided to compensation current source portion 30. Delay circuit 31 may essentially provide a delay period t1 corresponding to an operating delay time of internal circuit 1. In this way, signal $P_A$ may transition to a low level essentially a delay time t1 after active signal ACTIVE SIGNAL transitions to a high level. With signal $P_A$ at a low level, n-type IGFET 33 in compensation current source portion 30 turns off and compensation current Ic may be prevented. In this way, current consumption may be reduced.

Subsequently, active signal ACTIVE SIGNAL provided to internal circuit 1 may transition to a low level and internal circuit 1 may enter an inactive state. When internal circuit 1 enters an inactive state n-type IGFET 33 in compensation current source portion 30 may turn on and compensation current Ic may flow from internal voltage supply line 13 to ground. In this way, p-type IGFET 12 in voltage step-down portion 10 may be turned on and voltage step-down portion 10 may be biased in a relatively high gain state so that a response time to changes in a potential of internal voltage $V_{INT}$ may be increased.

As illustrated in FIG. 5, when internal circuit 1 is in an inactive state, compensation current Ic may be provided, thus current $I_0$ provided by voltage step-down portion 10 may be essentially equal to compensation current Ic of compensation current source portion 30 plus a leakage current of internal circuit 1. Thus, the operating point of p-type IGFET 12 may be within the active region and voltage step-down circuit 10 may be in a state in which the loop gain thereof is sufficiently high.

According to the embodiment of FIG. 3, when internal circuit 1 becomes an active state and current I of internal circuit 1 starts to increase, compensation current Ic from compensation current source portion 30 may be stopped. However, at this time, a sufficiently large operating current I may be drawn by internal circuit 1 so that there may be no instance in which an output current $I_0$ of voltage step-down portion 10 becomes less than compensation current Ic. In this way, the loop gain of voltage step-down portion 10 may remain in a high state at all times. Accordingly, voltage step-down portion 10 may quickly respond to a change of internal voltage $V_{INT}$ on internal voltage supply line 13. In this way, variations of internal voltage $V_{INT}$ provided by internal voltage step down portion 10 may be suppressed to be relatively small as indicated by the solid line shown in FIG. 5.

Also, according to the embodiment of FIG. 3, after active signal ACTIVE SIGNAL having a high level is provided to internal circuit 1, compensation current Ic may be prevented at essentially the timing in which consumption current I of internal circuit 1 increases. Thus, as compared to the embodiment of FIG. 1, a change in current $I_0$ provided from voltage step-down portion 10 from internal circuit transitioning from an inactive state to an active state may be reduced. Accordingly, a voltage following characteristic of voltage step-down portion 10 may be improved and a consumption current may be reduced.

Also, a plurality of internal circuits 1 may receive internal voltage supply line 13. In this case, by connecting a compensation current source portion 30 with each of internal circuits 1 and each compensation current source portion 30 having a delay 31 corresponding to the operating delay time of the respective internal circuit 1, a variation in an internal voltage $V_{INT}$ may be further suppressed.

Figure 6:
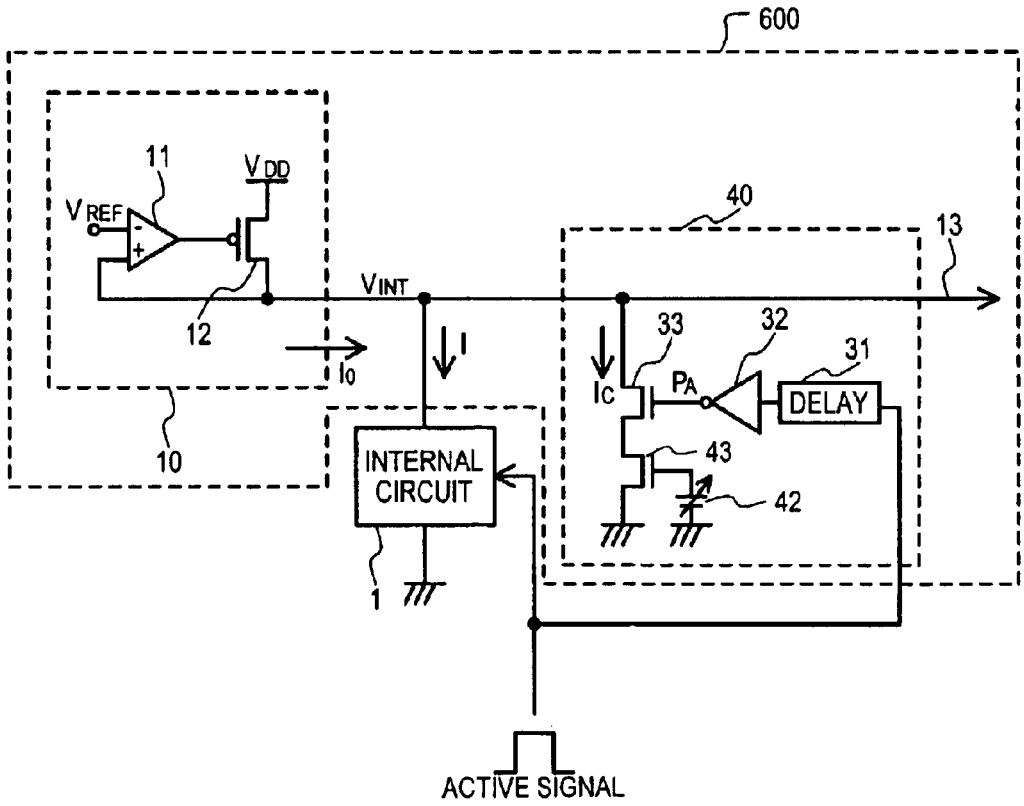
FIG. 6 is a circuit schematic diagram of a voltage step-down circuit and an internal circuit according to an embodiment.

Referring now to FIG. 6, a circuit schematic diagram of voltage step-down circuit 600 and an internal circuit 1 according to an embodiment is set forth. Voltage step-down circuit 600 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step down circuit 600 may include a compensation current source portion 40. Compensation current source portion 40 may include similar constituents a compensation current source portion 30 of FIG. 3 and such constituents may be referred to by the same reference character.

Compensation current source portion 40 may differ from compensation current source portion 30 of FIG. 3 in that compensation current source portion 40 may include a n-type IGFET 43 and a voltage source 42. N-type IGFET 43 may have a drain connected to a source of n-type IGFET 33, a gate connected to receive a potential provided by voltage source 42, and a source connected to ground. Thus, n-type IGFET 43 may be connected in series with n-type IGFET 33 between internal voltage supply line 13 and a ground potential terminal. Voltage source 42 may be a variable voltage source 42 for adjusting a compensation current Ic flowing through n-type IGFETs (43 and 33). The rest of the structure of compensation current source portion 40 may be similar to that of compensation current source portion 30 of FIG. 3 and thus, a detailed description may be omitted.

According to the embodiment of FIG. 6, compensation current Ic may be increased or decreased in accordance with a variation in leakage current flowing through internal circuit 1. In this way, an excessive current consumption by voltage step-down portion 10 may be prevented. Additionally, according to the embodiment of FIG. 6, n-type IGFET 43 for adjusting compensation current Ic may be connected in series with n-type IGFET 33. However, n-type IGFET 43 may be omitted if a potential of signal $P_A$ provided to a gate of n-type IGFET 33 is adjusted accordingly to adjust compensation current Ic.

Figure 7:
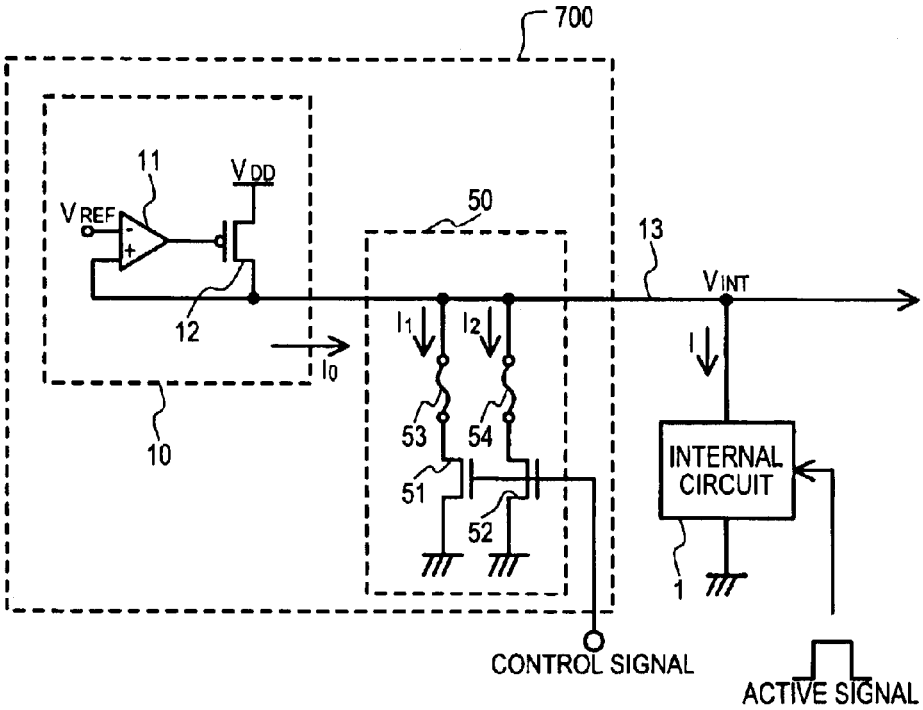
FIG. 7 is a circuit schematic diagram of a voltage step-down circuit and an internal circuit according to an embodiment.

Referring now to FIG. 7, a circuit schematic diagram of voltage step-down circuit 700 and an internal circuit 1 according to an embodiment is set forth. Voltage step-down circuit 700 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step down circuit 700 may include a compensation current source portion 50. Compensation current source portion 50 may be connected between internal voltage supply line 13 and a ground potential terminal and may provide internal power source stabilization. Compensation current source portion 50 may include n-type IGFETs (51 and 52) and fuses (53 and 54). Fuse 53 may be connected in series with n-type IGFET 51 between internal voltage supply line 13 and a ground potential terminal. Fuse 53 may have a first terminal connected to internal voltage supply line 13 and another terminal connected to a drain of n-type IGFET 51. N-type IGFET 51 may have a gate connected to receive a control signal CONTROL SIGNAL and a source connected to a ground potential terminal. Fuse 54 may be connected in series with n-type IGFET 52 between internal voltage supply line 13 and a ground potential terminal. Fuse 54 may have a first terminal connected to internal voltage supply line 13 and another terminal connected to a drain of n-type IGFET 52. N-type IGFET 52 may have a gate connected to receive a control signal CONTROL SIGNAL and a source connected to a ground potential terminal. In this way, the number of n-type IGFETs connected between internal voltage supply line 13 and a ground terminal may be set by trimming fuses (53 and 54) in accordance with a variation in leakage current of internal circuit 1 in an inactive state.

In the embodiment of FIG. 7, plural n-type IGFETs (51 and 52) may be connected in parallel between internal voltage supply line 13 and a ground terminal. Fuses (53 and 54) may be connected between internal voltage supply line 13 and drains of n-type IGFETs (51 and 52), respectively. Fuses (53 and 54) may be trimmed to provide an electrical connection or an electrical disconnection in accordance with a leakage current of devices in internal circuit 1. In this way, the number of n-type IGFETs connected between internal voltage supply line 13 and a ground potential terminal may be changed in accordance with a variation in a leakage current in devices in internal circuit 1.

For example, in the embodiment illustrated in FIG. 7, when the leakage current of internal circuit 1 is small, the compensation current source portion 50 may provide currents ($I_1$+$I_2$) as a compensation current by connecting n-type IGFETs (51 and 52) to internal voltage supply line 13 by leaving fuses (53 and 54) intact (no trimming). However, when leakage current of internal circuit 1 is relatively large, a fuse (53 or 54) associated with one of n-type IGFETs (51 or 52), respectively, may be electrically disconnected (trimmed) so that compensation current source portion 50 only provides one of currents ($I_1$ or $I_2$) as a compensation current. Values of currents ($I_1$ and $I_2$) may be made different from each other by sizing n-type IGFETs (51 and 52) accordingly.

In the example of FIG. 7, compensation current source portion 50 may include two parallel compensation current paths ($I_1$ and $I_2$) by providing two series connected fuse and n-type IGFET between internal voltage supply line 13 and a ground potential terminal. However, more than two such series circuit may be connected in parallel with each other to provide any number of parallel compensation current paths. In this way, a more precise control of compensation current provided by current source portion 50 may be obtained to vary in accordance with variations of a device leakage current of internal circuit 1.

Control signal CONTROL SIGNAL provide to gate electrodes of respective n-type IGFETs (51 and 52) may be any one of a constant DC voltage always provided as in the case of the embodiment of FIG. 1 or a pulse signal provided for preventing a compensation current when internal circuit 1 is in an active state as in the embodiment of FIG. 3.

Figure 8:
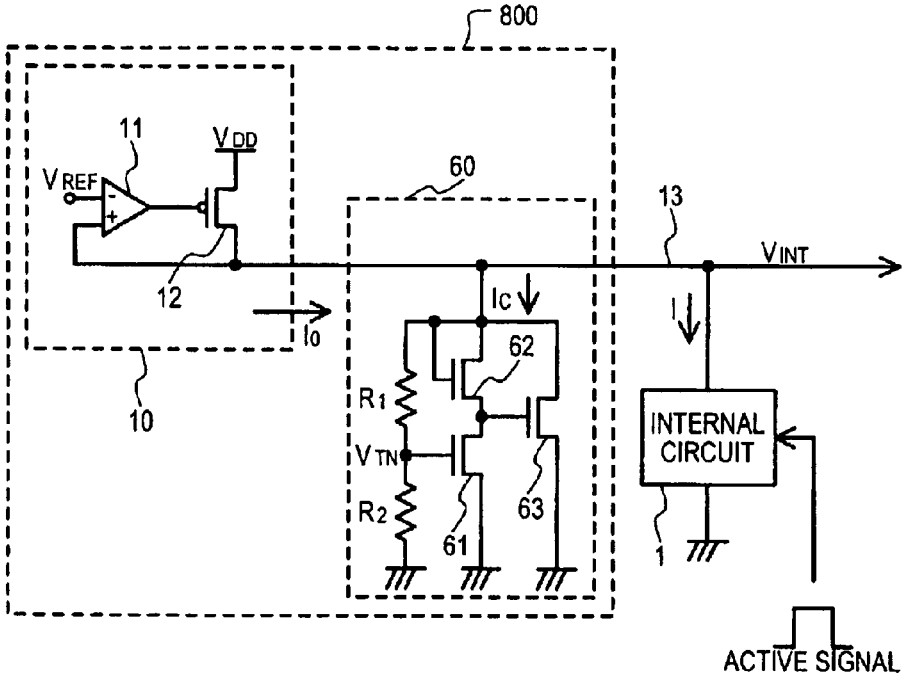
FIG. 8 is a circuit schematic diagram of a voltage step-down circuit and an internal circuit according to an embodiment.

Referring now to FIG. 8, a circuit schematic diagram of voltage step-down circuit 800 and an internal circuit 1 according to an embodiment is set forth. Voltage step-down circuit 800 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step down circuit 800 may include a compensation current source portion 60. Compensation current source portion 60 may be connected between internal voltage supply line 13 and a ground potential terminal and may provide internal power source stabilization. Compensation current source portion 60 may be located in the vicinity of internal circuit 1.

Compensation current source portion 60 may include resistors ($R_1$ and $R_2$) and n-type IGFETs (61 to 63). Resistor R1 may have a one terminal connected to internal voltage supply line 13 and another terminal connected to a voltage dividing output $V_{TN}$. Resistor R2 may have a one terminal connected to a voltage dividing output $V_{TN}$ another terminal connected to a ground potential terminal. N-type IGFET 62 may have a drain and gate commonly connected to internal voltage supply line 13 and a source connected to a gate of n-type IGFET 63 and a drain of n-type IGFET 61. N-type IGFET 61 may have a gate connected to voltage dividing output $V_{TN}$ and a source connected to a ground potential terminal. N-type IGFET 63 may have a drain connected to internal voltage supply line 13 and a source connected to a ground potential terminal.

Resistors ($R_1$ and $R_2$) may form a voltage dividing circuit to provide a voltage dividing output $V_{TN}$. Voltage dividing output $V_{TN}$ may be set to a value close to a threshold voltage of a n-type IGFET so that a variation in leakage current provided by an n-type IGFET in internal circuit 1 may be compensated.

A circuit composed of resistors ($R_1$ and $R_2$) and n-type IGFETs (61 and 62) may serve as an inverting amplifier for inversely amplifying voltage dividing output $V_{TN}$ and providing it to a gate electrode of n-type IGFET 63.

Voltage dividing output $V_{TN}$ provided by resistors ($R_1$ and $R_2$) may be set to a value close to a threshold voltage of n-type IGFET 61. Additionally, an output from the drain electrode of n-type IGFET 61 may be provided to a gate electrode of n-type IGFET 63 in which a compensation current Ic may flow from internal voltage supply line 13 to a ground potential terminal.

N-type IGFETs (61 and 63) of compensation current source portion 60 may have essentially the same configuration and formed with the same process as a n-type IGFET in internal circuit 1. In this way, all threshold voltages may be essentially equal to each other.

The operation of the embodiment of FIG. 8 will now be described.

A leakage current flowing through internal circuit 1 when internal circuit 1 is in an inactive state may be dependent on a threshold voltage of an n-type IGFET (not shown) in internal circuit 1. When a threshold voltage of the n-type IGFET is high, the leakage current may be small. When a threshold voltage of the n-type IGFET is low, the leakage current may be large.

By providing n-type IGFET 61 having essentially the same size and configuration as the n-type IGFET in internal circuit 1 providing the leakage current, n-type IGFET 61 may have essentially the same threshold voltage as the n-type IGFET in internal circuit 1. Thus, for example, when a threshold voltage of n-type IGFET in internal circuit 1 is high and a device leakage current is small, the threshold voltage of n-type IGFET 61 becomes higher than voltage dividing output $V_{TN}$ provided by voltage dividing configured resistors ($R_1$ and $R_2$). In this way, n-type IGFETs 61 may provide a higher impedance value so that a gate n-type IGFET 63 may receive a high voltage.

With a gate voltage of n-type IGFET 63 high, n-type IGFET 63 may be turned on and compensation current Ic may be increased. In this way, when a threshold voltage of an n-type IGFET in internal circuit 1 is high and a leakage current is small, compensation current Ic provided by compensation current source portion 60 may be increased.

Similarly, when a threshold voltage of a n-type IGFET in internal circuit 1 is low, the device leakage current is large. Because n-type IGFET 61 may have similar characteristics, a threshold voltage of n-type IGFET 61 may also be low and may be lower than a voltage dividing output $V_{TN}$ provided by voltage dividing configured resistors ($R_1$ and $R_2$). With a threshold voltage lower than voltage dividing output $V_{TN}$, n-type IGFET 61 may be turned on and a low voltage may be provided to a gate of n-type IGFET 63. With a low gate voltage, n-type IGFET 63 may provide a higher impedance value and compensation current Ic may be decreased. In this way, when a threshold voltage of an n-type IGFET in internal circuit 1 is low and a leakage current is large, compensation current Ic provided by compensation current source portion 60 may be decreased.

Thus, when a threshold voltage of a n-type IGFET in internal circuit 1 is high and device leakage current has a relatively small value, compensation current Ic provided by compensation current source portion 60 may be increased. When a threshold voltage of a n-type IGFET in internal circuit 1 is low and the device leakage current has a relatively large value, compensation current Ic provided by compensation current source portion 60 may be decreased. Accordingly, even if there is a variation in a leakage current of internal circuit 1 due to, for example process variations or the like, a variation in an output current $I_0$ provided from voltage step-down portion 10 may be suppressed. In this way, product yield may be improved.

Figure 9:
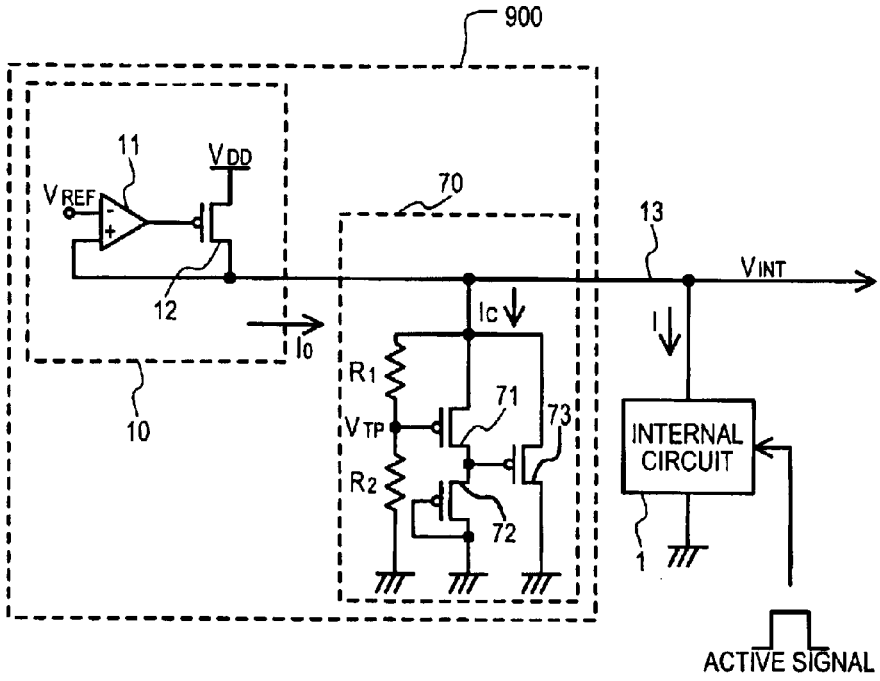
FIG. 9 is a circuit schematic diagram of a voltage step-down circuit and an internal circuit according to an embodiment.

Referring now to FIG. 9, a circuit schematic diagram of voltage step-down circuit 900 and an internal circuit 1 according to an embodiment is set forth. Voltage step-down circuit 900 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step-down circuit 900 may include a compensation current source portion 70. Compensation current source portion 70 may be connected between internal voltage supply line 13 and a ground potential terminal and may provide internal power source stabilization. Compensation current source portion 70 may be located in the vicinity of internal circuit 1.

Compensation current source portion 70 may include resistors ($R_1$ and $R_2$) and p-type IGFETs (71 to 73). Resistor R1 may have a one terminal connected to internal voltage supply line 13 and another terminal connected to a voltage dividing output $V_{TP}$. Resistor R2 may have a one terminal connected to a voltage dividing output $V_{TP}$ another terminal connected to a ground potential terminal. P-type IGFET 72 may have a drain and gate commonly connected to a ground potential and a source connected to a gate of p-type IGFET 73 and a drain of p-type IGFET 71. P-type IGFET 71 may have a gate connected to voltage dividing output $V_{TP}$ and a source connected to a internal voltage supply line 13. P-type IGFET 73 may have a source connected to internal voltage supply line 13 and a drain connected to a ground potential terminal.

Resistors ($R_1$ and $R_2$) may form a voltage dividing circuit to provide a voltage dividing output $V_{TP}$. Voltage dividing output $V_{TP}$ may be set to a value close to a threshold voltage of a p-type IGFET with respect to internal voltage $V_{INT}$, SO that a variation in leakage current provided by a p-type IGFET in internal circuit 1 may be compensated.

A circuit composed of resistors ($R_1$ and $R_2$) and p-type IGFETs (71 and 72) may serve as an inverting amplifier for inversely amplifying voltage dividing output $V_{TP}$ and providing it to a gate electrode of p-type IGFET 73.

Voltage dividing output $V_{TP}$ provided by resistors ($R_1$ and $R_2$) may be set to a value close to a threshold voltage of p-type IGFET 71 with respect to internal voltage $V_{INT}$. Additionally, an output from the drain electrode of p-type IGFET 71 may be provided to a gate electrode of p-type IGFET 73 in which a compensation, current Ic may flow from internal voltage supply line 13 to a ground potential terminal.

P-type IGFETs (71 and 73) of compensation current source portion 70 may have essentially the same configuration and formed with the same process as a p-type IGFET in internal circuit 1. In this way, all threshold voltages may be essentially equal to each other.

The operation of the embodiment of FIG. 9 will now be described.

A leakage current flowing through internal circuit 1 when internal circuit 1 is in an inactive state may be dependent on a threshold voltage of a p-type IGFET (not shown) in internal circuit 1. When a threshold voltage of the p-type IGFET is high, the leakage current may be small. When a threshold voltage of the p-type IGFET is low, the leakage current may be large.

By providing p-type IGFET 71 having essentially the same size and configuration as the p-type IGFET in internal circuit 1 providing the leakage current, p-type IGFET 71 may have essentially the same threshold voltage as the p-type IGFET in internal circuit 1. Thus, for example, when a threshold voltage of p-type IGFET in internal circuit 1 is high and a device leakage current is small, the threshold voltage of p-type IGFET 71 becomes higher than voltage dividing output $V_{TP}$ (with respect to internal voltage $V_{INT}$) provided by voltage dividing configured resistors ($R_1$ and $R_2$). In this way, p-type IGFETs 71 may provide a higher impedance value so that a gate p-type IGFET 73 may receive a low voltage.

With a gate voltage of p-type IGFET 73 low, p-type IGFET 73 may be turned on and compensation current Ic may be increased. In this way, when a threshold voltage of an p-type IGFET in internal circuit 1 is high and a leakage current is small, compensation current Ic provided by compensation current source portion 70 may be increased.

Similarly, when a threshold voltage of a p-type IGFET in internal circuit 1 is low, the device leakage current is large. Because p-type IGFET 71 may have similar characteristics, a threshold voltage of p-type IGFET 71 may also be low and may be lower than a voltage dividing output $V_{TP}$ (with respect to internal voltage $V_{INT}$) provided by voltage dividing configured resistors ($R_1$ and $R_2$). With a threshold voltage lower than voltage dividing output $V_{TP}$, p-type IGFET 71 may be turned on and a high voltage may be provided to a gate of p-type IGFET 73. With a high gate voltage, p-type IGFET 73 may provide a higher impedance value and compensation current Ic may be decreased. In this way, when a threshold voltage of a p-type IGFET in internal circuit 1 is low and a leakage current is large, compensation current Ic provided by compensation current source portion 70 may be decreased.

Thus, when a threshold voltage of a p-type IGFET in internal circuit 1 is high and device leakage current has a relatively small value, compensation current Ic provided by compensation current source portion 70 may be increased. When a threshold voltage of a p-type IGFET in internal circuit 1 is low and the device leakage current has a relatively large value, compensation current Ic provided by compensation current source portion 70 may be decreased. Accordingly, even if there is a variation in a leakage current of internal circuit 1 due to, for example process variations or the like, a variation in an output current $I_0$ provided from voltage step-down portion 10 may be suppressed. In this way, product yield may be improved.

Figure 10:
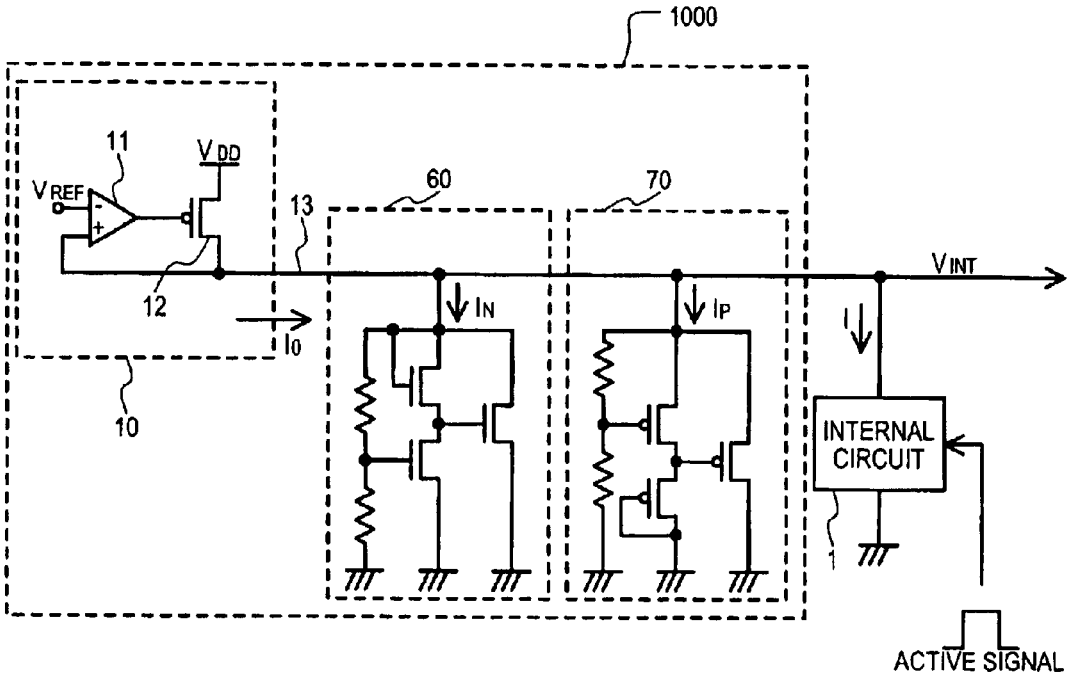
FIG. 10 is a circuit schematic diagram of a voltage step-down circuit and an internal circuit according to an embodiment.

Referring now to FIG. 10, a circuit schematic diagram of voltage step-down circuit 1000 and an internal circuit 1 according to an embodiment is set forth. Voltage step-down circuit 1000 may include voltage step-down portion 10 which may have the same structure as voltage step-down circuit portion 10 illustrated in the embodiment of FIG. 1. Also, internal circuit 1 may have the same structure as internal circuit 1 illustrated in the embodiment of FIG. 1.

Voltage step-down circuit 1000 may include a compensation current source portions (60 and 70). Compensation current source portion 60 may be the same as compensation current source portion 60 in the embodiment of FIG. 8, thus a description of the configuration and operation may be omitted. Compensation current source portion 70 may be the same as compensation current source portion 70 in the embodiment of FIG. 9, thus a description of the configuration and operation may be omitted. Compensation current source portions (60 and 70) may be connected in parallel between internal voltage supply line 13 and a ground potential terminal and may provide internal power source stabilization. Compensation current source portions (60 and 70) may be located in the vicinity of internal circuit 1. Compensation current source portion 60 may provide a compensation current $I_N$, which may be varied in accordance with a leakage current provided by n-type IGFETs in internal circuit 1. Compensation current source portion 70 may provide a compensation current $I_P$, which may be varied in accordance with a leakage current provided by p-type IGFETs in internal circuit 1. In this way, voltage step-down circuit 1000 may provide compensation current ($I_N$+$I_P$) when a leakage current I in internal circuit 1 is provided by leakage current of n-type IGFETs and p-type IGFETs in internal circuit 1. Thus, voltage step-down circuit 1000 including compensation current source portions (60 and 70) may be useful when internal circuit 1 is a complementary circuit, such as a CMOS (complementary metal oxide semiconductor) circuit.

Note, that a structure in which a control signal or potential (such as in the embodiments of FIG. 1 or 3, for example) may be provided to n-type IGFET 63 and/or p-type IGFET 73 in the embodiments of FIGS. 8 to 10.

Figure 11:
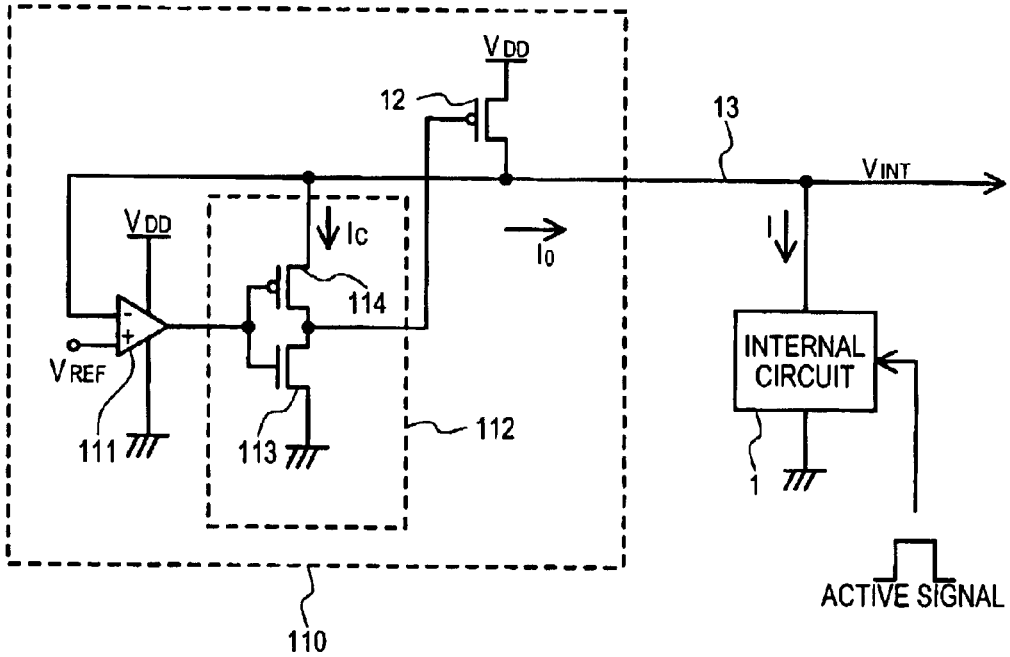
FIG. 11 is a circuit schematic diagram of a voltage step-down circuit and an internal circuit according to an embodiment.

Referring now to FIG. 11, a circuit schematic diagram of voltage step-down circuit 110 and an internal circuit 1 according to an embodiment is set forth. Internal circuit 1 may have the same structure as internal circuit 1 illustrated in the embodiment of FIG. 1.

Voltage step-down circuit 110 may include a differential amplifier 111, an amplifier 112, and a driver p-type IGFET 12. Differential amplifier 111 may receive reference voltage $V_{REF}$ at a non-inverting input terminal (indicated with a plus +) and internal voltage $V_{INT}$ at an inverting input terminal (indicated with a minus –) and may provide an output as an input to amplifier 112. Amplifier 112 may provide an output to a gate of driver p-type IGFET 12. Driver p-type IGFET 12 may have a source electrode connected to receive external power source voltage $V_{DD}$ and a drain connected to internal power source line 13. In this way, internal voltage step-down portion 110 may provide internal voltage $V_{INT}$ at the drain of driver p-type IGFET 12. Internal voltage $V_{INT}$ may be stepped-down voltage from external power source voltage $V_{DD}$.

Amplifier 112 may include a n-type IGFET 113 and a p-type IGFET 114. P-type IGFET 114 may have a source connected to internal power source line 13, a gate connected to receive the output of differential amplifier 111 and a drain connected to the gate of driver p-type IGFET 12 and the drain of n-type IGFET 113. N-type IGFET 113 may have a gate connected to receive the output of differential amplifier 111 and a source connected to a ground potential terminal.

Amplifier 112 may be connected between internal voltage supply line 13 and ground potential so that an operating current Ic may be provided from internal voltage supply line 13. In this way, operating current Ic may also serve as a compensation current source for internal power source stabilization.

Amplifier 112, may amplify an output of differential amplifier 111 to provide an output to a gate of driver p-type IGFET 12. Driver p-type IGFET 12 may provide an output current $I_0$ provided from voltage step-down circuit 110.

The operation of the embodiment of FIG. 11 will now be described.

Differential amplifier 111 of voltage step-down circuit 110 may compare internal voltage $V_{INT}$ on internal power source line 13 with reference voltage $V_{REF}$. When internal voltage $V_{INT}$ is lower than reference voltage $V_{REF}$, differential amplifier 111 provides a high output as an input to amplifier 112. With a high level provided as an input to amplifier 112, p-type IGFET 114 may transition toward a higher impedance state and n-type IGFET 113 may transition to a lower impedance state and the output of amplifier 112 may become lower. As a result, the impedance of driver p-type IGFET 12 may become lower and output current $I_0$ provided from external power source voltage $V_{DD}$ to internal power source line 13 through driver p-type IGFET 12 may increase. In this way, internal voltage $V_{INT}$ may rise.

On the other hand, when internal voltage $V_{INT}$ is higher than reference voltage $V_{REF}$, differential amplifier 111 provides a low output as an input to amplifier 112. With a low level provided as an input to amplifier 112, p-type IGFET 114 may transition toward a lower impedance state and n-type IGFET 113 may transition to a higher impedance state and the output of amplifier 112 may become higher. As a result, the impedance of driver p-type IGFET 12 may become lower and output current $I_0$ provided from external power source voltage $V_{DD}$ to internal power source line 13 through driver p-type IGFET 12 may decrease. In this way, internal voltage $V_{INT}$ may become lower in response to current consumption (for example currents (I and Ic).

With such a feedback operation as described above, internal voltage $V_{INT}$ may be controlled such that it may be essentially equal to reference voltage $V_{REF}$.

In accordance with the embodiment of FIG. 11, internal voltage $V_{INT}$ may provide an operating power source for amplifier 112. Thus, when internal voltage $V_{INT}$ rises, an output voltage of amplifier 112 may also rise. When the output voltage of amplifier 112 rises, driver p-type IGFET 12 may have an increased impedance and may therefore provide a lower output current $I_0$. With a lower output current $I_0$, internal voltage $V_{INT}$ may tend to lower. On the other hand, when internal voltage $V_{INT}$ is reduced, an output voltage of amplifier 112 may be reduced. When the output voltage of amplifier 112 is reduced, driver p-type IGFET 12 may have a decreased impedance and may therefore provide a higher output current $I_0$. With a higher output current $I_0$, internal voltage $V_{INT}$ may tend to raise.

In this way, a feedback loop including differential amplifier 111, amplifier 112, and driver p-type IGFET 12 may provide synergism to maintain an internal voltage $V_{INT}$ while providing a compensation current Ic to keep a loop gain higher so that a response time to current demands may be improved.

According to the embodiment of FIG. 11, an output of differential amplifier 111 may be amplified by amplifier 112. Amplifier 112 may be a complementary type amplifier (such as a CMOS amplifier) and may include a n-type IGFET 113 and p-type IGFET 114. In this way, the sensitivity of voltage step-down circuit 110 may be improved without increasing an operating current of differential amplifier 111. In addition, internal voltage $V_{INT}$ may provide an operating power source for amplifier 112. Thus, feedback loops may be produced so that a reduction in consumption power and an improvement in a response characteristic to a change in internal voltage $V_{INT}$ may be realized. In this way, internal voltage $V_{INT}$ may be stabilized without providing a compensation current source portion separate from an amplifying portion of a voltage step-down circuit.

Figure 12:
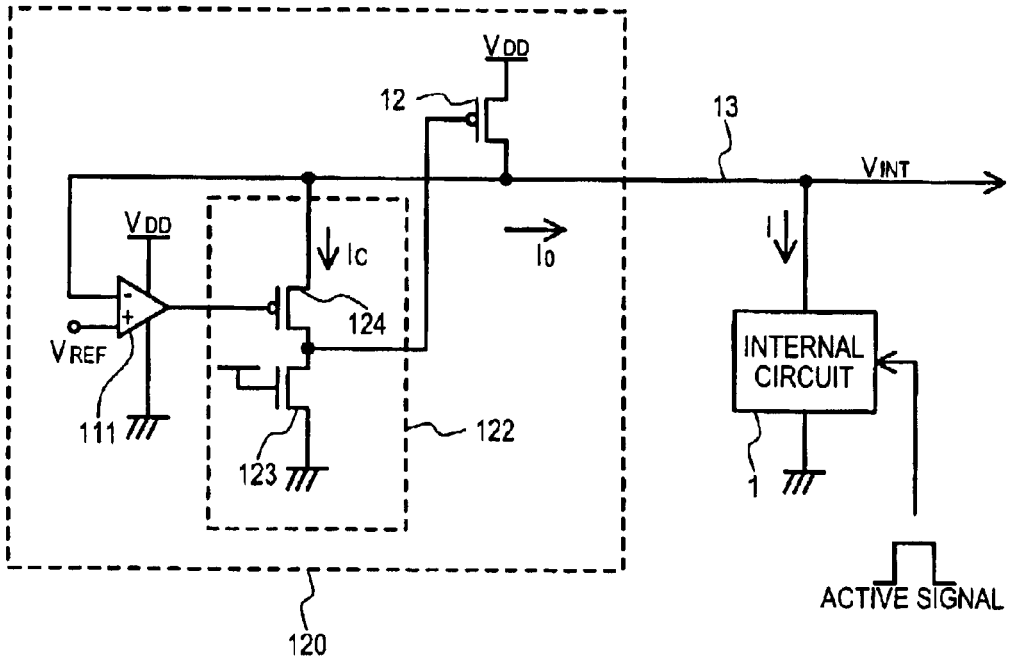
FIG. 12 is a circuit schematic diagram of a voltage step-down circuit and an internal circuit according to an embodiment.

Referring now to FIG. 12, a circuit schematic diagram of voltage step-down circuit 120 and an internal circuit 1 according to an embodiment is set forth. Internal circuit 1 may have the same structure as internal circuit 1 illustrated in the embodiment of FIG. 1.

Voltage step-down circuit 120 may include a differential amplifier 111 and a driver p-type IGFET 12 as in voltage step-down circuit 110 of FIG. 11. However, voltage step-down circuit 120 may differ from voltage step down circuit 110 in that an amplifier 122 may be included instead of amplifier 112. Amplifier 122 may receive an output of differential amplifier 111 and may provide an output to a gate of driver p-type IGFET 12.

Amplifier 122 may include a n-type IGFET 123 and a p-type IGFET 124. P-type IGFET 124 may have a source connected to internal power source line 13, a gate connected to receive the output of differential amplifier 111 and a drain connected to the gate of driver p-type IGFET 12 and the drain of n-type IGFET 113. N-type IGFET 123 may have a gate connected to a power supply and a source connected to a ground potential terminal. N-type IGFET 123 may provide a constant current load to amplifier 122.

Amplifier 122 may be connected between internal voltage supply line 13 and ground potential so that an operating current Ic may be provided from internal voltage supply line 13. In this way, operating current Ic may also serve as a compensation current source for internal power source stabilization.

The operation of the embodiment of FIG. 12 will now be described.

Differential amplifier 111 of voltage step-down circuit 120 may compare internal voltage $V_{INT}$ on internal power source line 13 with reference voltage $V_{REF}$. When internal voltage $V_{INT}$ is lower than reference voltage $V_{REF}$, differential amplifier 111 provides a high output as an input to amplifier 122. With a high level provided as an input to amplifier 122, p-type IGFET 124 may transition toward a higher impedance state and the output of amplifier 122 may become lower. As a result, the impedance of driver p-type IGFET 12 may become lower and output current $I_0$ provided from external power source voltage $V_{DD}$ to internal power source line 13 through driver p-type IGFET 12 may increase. In this way, internal voltage $V_{INT}$ may rise.

On the other hand, when internal voltage $V_{INT}$ is higher than reference voltage $V_{REF}$, differential amplifier 111 provides a low output as an input to amplifier 122. With a low level provided as an input to amplifier 122, p-type IGFET 124 may transition toward a lower impedance state and the output of amplifier 122 may become higher. As a result, the impedance of driver p-type IGFET 12 may become lower and output current $I_0$ provided from external power source voltage $V_{DD}$ to internal power source line 13 through driver p-type IGFET 12 may decrease. In this way, internal voltage $V_{INT}$ may become lower in response to current consumption (for example currents (I and Ic).

With such a feedback operation as described above, internal voltage $V_{INT}$ may be controlled such that it may be essentially equal to reference voltage $V_{REF}$.

According to the embodiment of FIG. 12, an output of differential amplifier 111 may be amplified by amplifier 122 including p-type IGFET 124. In this way, the sensitivity of voltage step-down circuit 120 may be improved without increasing an operating current of differential amplifier 111. In addition, internal voltage $V_{INT}$ may provide an operating power source for amplifier 122. Thus, feedback loops may be produced so that a reduction in consumption power and an improvement in a response characteristic to a change in internal voltage $V_{INT}$ may be realized. In this way, internal voltage $V_{INT}$ may be stabilized without providing a compensation current source portion separate from an amplifying portion of a voltage step-down circuit.

According to the embodiment of FIG. 12, a feedback loop including differential amplifier 111, amplifier 122, and driver p-type IGFET 12 may provide synergism to maintain an internal voltage $V_{INT}$ while providing a compensation current Ic to keep a loop gain higher so that a response time to current demands may be improved. Note that, even when a modification is made in FIG. 12 such that an output of differential amplifier 111 is provided to a gate electrode of n-type IGFET 123 and a p-type IGFET 124 is configured as the constant current load, essentially the same effect may be obtained.

Figure 13:
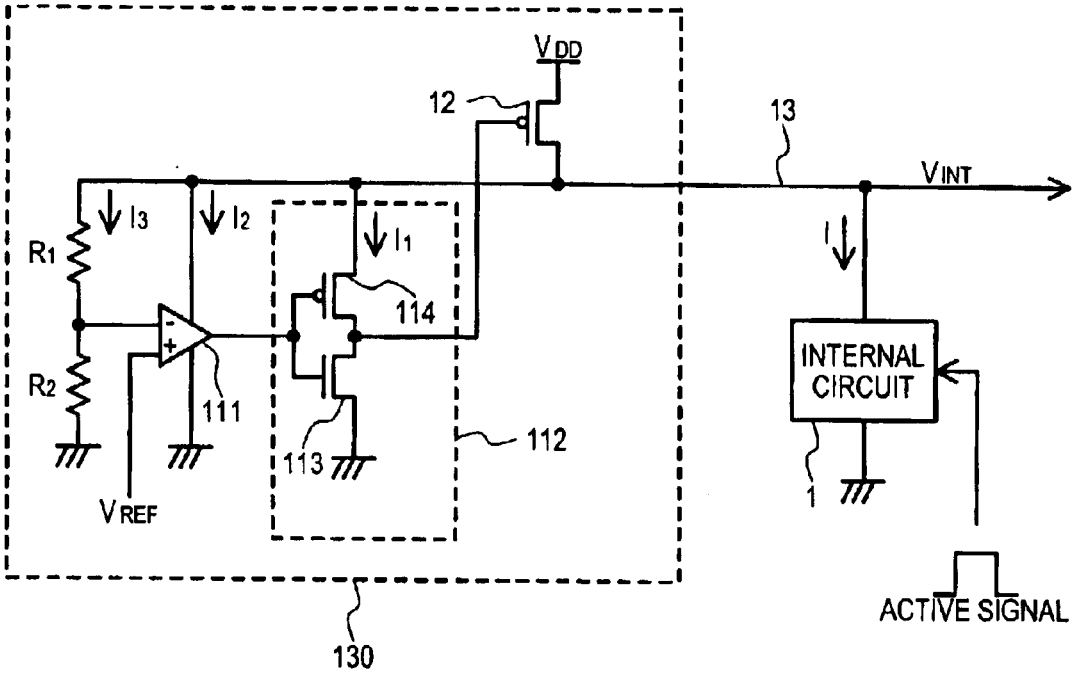
FIG. 13 is a circuit schematic diagram of a voltage step-down circuit and an internal circuit according to an embodiment.

Referring now to FIG. 13, a circuit schematic diagram of voltage step-down circuit 130 and an internal circuit 1 according to an embodiment is set forth. Internal circuit 1 may have the same structure as internal circuit 1 illustrated in the embodiment of FIG. 1.

Voltage step-down circuit 130 may include a differential amplifier 111, a driver p-type IGFET 12, and an amplifier 112 as in voltage step-down circuit 110 of FIG. 11. However, voltage step-down circuit 130 may differ from voltage step down circuit 110 in that resistors ($R_1$ and $R_2$) may be included and internal voltage $V_{INT}$ may provide an operating power source for differential amplifier 111.

Resistor $R_1$ may have one terminal connected to internal power source line 13 and another terminal connected to an inverting input of amplifier 111. Resistor $R_2$ may have one terminal connected to the inverting input of amplifier 111 and another terminal connected to a ground potential terminal. In this way, a voltage obtained by dividing internal voltage $V_{INT}$ by resistors ($R_1$ and $R_2$) may be provided to the inverting input terminal of differential amplifier 111. In this way, a voltage of $V_{INT}\ R_2/(R_1+R_2)$ may be applied to the inverting input terminal of differential amplifier 111 and internal voltage $V_{INT}$ may be set to $V_{REF}\ (R_1+R_2)/R_2$.

The fundamental operation of the embodiment of FIG. 13 may be similar to the operation of the embodiment of FIG. 11. Thus, the detailed description is omitted. In the embodiment of FIG. 13, internal voltage $V_{INT}$ may be used as an operating power source for voltage divider configured from resistors ($R_1$ and $R_2$), differential amplifier 111, and amplifier 112. In this way, a sum ($I_1+I_2+I_3$) of an operating current $I_1$ of amplifier 112, an operating current $I_2$ of differential amplifier 111, and an operating current $I_3$ flowing into a voltage divider circuit configured from resistors ($R_1$ and $R_2$) may serve as a compensation current source for internal power source stabilization. Accordingly, a current value of the compensation current source may be increased and a compensation current value may be easily selected, for example, by modifying values of resistors ($R_1$ and $R_2$) while maintaining a resistance ratio in accordance with a value of internal voltage $V_{INT}$ desired.

Note that, the embodiment of FIG. 13 may be modified such that within amplifier 112 one of IGFETs (113 or 114)

may be configured to operate as a constant current load as in the embodiment of FIG. 12 and a similar effect may be obtained.

Figure 14:
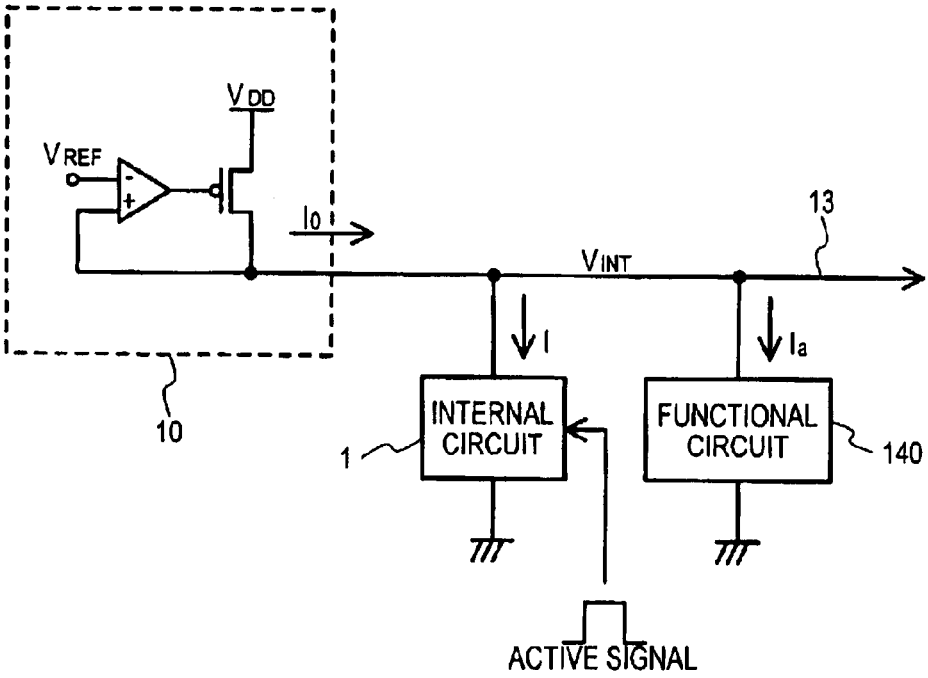
FIG. 14 is a circuit schematic diagram of a voltage step-down circuit, a functional circuit, and an internal circuit according to an embodiment.

Referring now to FIG. 14, a circuit schematic diagram of voltage step-down circuit 10, an internal circuit 1, and a functional circuit 140 according to an embodiment is set forth. Voltage step-down circuit 10 may have the same structure as voltage step-down circuit portion 10 illustrated in the embodiment of FIG. 1. Also, internal circuit 1 may have the same structure as internal circuit 1 illustrated in the embodiment of FIG. 1.

The embodiment of FIG. 14 may differ from the embodiment of FIG. 1 in that a functional circuit 140 may be included instead of a compensation current source portion 20. Internal voltage $V_{INT}$ may provide an operating power source for functional circuit 140. Thus, an operating current $I_a$ flowing into functional circuit 140 may serve as a compensation current source for internal power source stabilization.

As functional circuit 140 is connected with internal voltage supply line 13, a suitable functional circuit may be used which may be operated by an internal step down voltage such as internal voltage $V_{INT}$. As just a few examples of a suitable functional circuit 140 may include a first stage input buffer for receiving a low amplitude signal, a level changing circuit, an amplifying circuit such as a sense amplifier, a constant current generating circuit used in a step-down voltage system, or a memory cell, latch circuit or the like in which a leakage current (steady-state current) may be required for voltage holding.

According to the embodiment of FIG. 14, even in a state in which internal circuit 1 is in an inactive state and only a minute leakage current is consumed, the predetermined operating current $I_a$ may flow into functional circuit 140. Thus, a current which is greater than or equal to operating current $I_a$ may always be provided as an output current $I_0$ from voltage step-down circuit 10 and a loop gain may be kept to a sufficiently high value. Accordingly, voltage step-down circuit 10 may quickly respond to a change of internal voltage $V_{INT}$ on internal voltage supply line 13. In this way, variations of internal voltage $V_{INT}$ provided by internal voltage step down circuit 10 may be suppressed to be relatively small. In addition, because it may be unnecessary to provide a separate compensation current source, power consumption may be reduced.

According to the embodiments, a compensation current source may provide compensation for the output current of a voltage step-down circuit at a time when an internal circuit powered by an internal voltage is inactive (standby). The compensation may be provided, for example, in response to the internal circuit being switched from an active state to an inactive state in response to an active signal. However, if a leakage current, at a time when the internal circuit is inactive, is intentionally controlled or determined, the compensation current may be provided in accordance with the leakage current.

The device leakage current flowing into an internal circuit at a time when the internal circuit is in an inactive state (standby mode) may be a subthreshold leakage and a value dependent on a subthreshold voltage Vth of an IGFET. Generally, the device leakage current may be less than 5% of a current flowing at a time when the internal circuit is in an active state (active mode). Thus, device parameters may be set so as to increase the leakage current, for example, by utilizing an interband leakage current of an IGFET, such as a MOSFET included in the internal circuit, a tunnel current of a gate oxide film, and/or a subthreshold leakage current (increased for example, by intentionally reducing a threshold voltage). Accordingly, it may be possible that the device leakage current at a time when the internal circuit is in an inactive state (standby mode) may be increased to 5% or more of a current flowing in an active state (active mode). In this way, the sensitivity of a voltage step-down circuit may be improved by the increased device leakage current and thereby the response characteristics of the voltage standby circuit may be improved.

According to the embodiments, an internal voltage step-down circuit may include an internal voltage step-down portion for comparing a reference voltage with an internal voltage and generating an internal voltage obtained by reducing an external power source voltage in accordance with a comparison result. An internal voltage supply line may be connected with an internal circuit. The internal circuit may be powered by the internal voltage and may be switched between an active state and an inactive state in response to an active signal. A compensation current source may be provided between an internal voltage supply line and a ground potential terminal. The compensation current source may provide a compensation current for biasing the voltage step-down circuit to provide a predetermined output current at a time when the internal circuit is inactive. In this way, a response characteristic of the voltage step-down circuit portion may be improved. Accordingly, an undershoot or an overshoot of the internal voltage, which may be caused at a time when the internal circuit enters an active state to sharply increase a current consumption or when the internal circuit is switched from an active state to an inactive state to rapidly decrease a current consumption, may be prevented.

Also, according to the embodiments, a voltage step-down circuit for reducing an external power source voltage to a predetermined internal voltage potential may include a differential amplifier, an amplifier, and a driver p-type IGFET. The differential amplifier may receive a reference voltage at one terminal and an internal voltage at another terminal and may provide an output as an input to the amplifier. The amplifier may provide an output to a gate of the driver p-type IGFET. The driver p-type IGFET may have a source connected to the external power source and may provide the internal voltage at a drain electrode. An operating current of the amplifier and/or the differential amplifier may be provided from an internal voltage supply line. In this way, the amplifier and/or the differential amplifier may serve as compensation current sources for setting an output current of the voltage step-down circuit to a predetermined value at a time when an internal circuit is inactive. Thus, a response characteristic of the voltage step-down circuit may be improved without increasing a consumption current. Accordingly, an undershoot or an overshoot of the internal voltage, which may be caused at a time when the internal circuit enters an active state to sharply increase a current consumption or when the internal circuit is switched from an active state to an inactive state to rapidly decrease a current consumption, may be efficiently prevented and a variation in the internal voltage may be reduced.

According to the embodiments, a voltage step-down circuit for reducing an external power source voltage to a predetermined internal voltage potential may provide the internal voltage to an internal voltage supply line. An internal circuit connected to the internal voltage supply line may be switched between an active state and an inactive state in response to an active signal. The internal voltage supply line may provide power to a function circuit. An operating current of the functional circuit may serve as a compensation current source for setting an output current of the voltage step-down circuit to a predetermined value at a time when an internal circuit is inactive. Thus, a response characteristic of the voltage step-down circuit may be improved without increasing a consumption current. Accordingly, an undershoot or an overshoot of the internal voltage, which may be caused at a time when the internal circuit enters an active state to sharply increase a current consumption or when the internal circuit is switched from an active state to an inactive state to rapidly decrease a current consumption, may be efficiently prevented and a variation in the internal voltage may be reduced.

It is understood that the embodiments described above are exemplary and the present invention should not be limited to those embodiments. Specific structures should not be limited to the described embodiments.

For example, an internal circuit 1 may include a device which may provide a leakage current I in a standby state. The leakage current I may be set to a predetermined minimum by designing a device parameter so that the device may provide sufficient leakage current to allow output current $I_0$ to be set at a minimum level even though internal circuit 1 is in a standby state. In this way, a voltage step-down circuit 10 may be biased in a condition so that a response to variations in an internal voltage $V_{INT}$ on an internal power source line 13 may be rapidly responded to by the voltage step-down circuit 10. Thus, leakage current I in an internal device 1 may have a compensation current Ic inherently designed thereto. For example, the device may be an IGFET or the like and may have a short channel length as compared to other devices or may have an intentionally designed low threshold voltage as compared to other like devices, as just a few examples.

Thus, while the various particular embodiments set forth herein have been described in detail, the present invention could be subject to various changes, substitutions, and alterations without departing from the spirit and scope of the invention. Accordingly, the present invention is intended to be limited only as defined by the appended claims.

What is claimed is:

1. A voltage step-down circuit, comprising:

a voltage step-down portion that compares a reference voltage with an internal voltage and generating the internal voltage by reducing an external power source voltage in accordance with a comparison result;

an internal voltage supply line coupled to receive the internal voltage and providing power to an internal circuit;

the internal circuit having an active state and an inactive state; and a compensation current source portion coupled to the internal voltage supply line that provides a compensation current for compensating an output current of the voltage step-down portion at a time when the internal circuit is in the inactive state.

2. The voltage step-down circuit according to claim 1, wherein:

the voltage step-down portion includes a differential amplifier coupled to receive the reference voltage at a first input terminal and the internal voltage at a second input terminal and providing the comparison result; and a driver transistor providing a current path for the output current between the external power source voltage and the internal voltage supply line and having a driver transistor control terminal coupled to receive the comparison result.

3. The voltage step-down circuit according to claim 2, wherein:

the driver transistor is a p-type insulated gate field effect transistor (IGFET) having a driver transistor source coupled to receive the external power source voltage and a driver transistor drain coupled to the internal voltage supply line.

4. The voltage step-down circuit according to claim 1, wherein:

the compensation current source portion is essentially disables the compensation when the internal circuit is in the active state and a consumption current of the internal circuit is increased as compared to when the internal circuit is in the inactive state.

5. The voltage step-down circuit according to claim 1, wherein:

the compensation current source portion includes a n-type insulated gate field effect transistor (IGFET) providing a controllable current path between the internal voltage supply line and a ground potential; and a bias voltage generating circuit providing a bias voltage to a control gate of the n-type IGFET for setting the compensation current.

6. The voltage step-down circuit according to claim 1, wherein:

the compensation current source portion includes a first n-type insulated gate field effect transistor (IGFET) having a first controllable impedance path coupled in series with a second controllable impedance path of a second n-type IGFET between the internal voltage supply line and a ground potential;

a control gate of the first n-type IGFET coupled to receive a control signal for inhibiting the compensation current when the internal circuit is in the active state and a consumption current of the internal circuit is increased as compared to when the internal circuit is in the inactive state; and a bias voltage generating circuit providing a bias voltage to a control gate of the second n-type IGFET for setting the compensation current.

7. The voltage step-down circuit according to claim 1, wherein:

the compensation current source portion includes a first n-type insulated gate field effect transistors (IGFET) connected in series with a first programmable device between the internal voltage supply line and a ground potential; and a second n-type IGFETs connected in series with a second programmable device between the internal voltage supply line and the ground potential.

8. The voltage step-down circuit according to claim 1, wherein:

the compensation current source portion includes a first voltage dividing circuit connected between the internal voltage supply line and a ground potential and providing a first voltage dividing output;

a first inverting amplifier coupled to receive the first voltage dividing output and providing a first inverting amplifier output; and a n-type insulated gate field effect transistor (IGFET) providing a controllable impedance path between the internal voltage supply line and the ground potential and having a control gate coupled to receive the first inverting amplifier output.

9. The voltage step-down circuit according to claim 8, wherein:

the first inverting amplifier includes a first n-type IGFET having a source coupled to the ground potential, and a drain coupled to the first inverting amplifier output, and a gate coupled to receive the first voltage dividing output; and a second n-type IGFET having a source coupled to the first inverting amplifier output and a drain and a gate coupled to the internal voltage supply line.

10. The voltage step-down circuit according to claim 9, wherein:

the first voltage dividing circuit provides the first voltage dividing output at a potential close to a threshold voltage of a n-type IGFET.

11. The voltage step-down circuit according to claim 8, wherein:

the compensation current source portion further includes a second voltage dividing circuit connected between the internal voltage supply line and a ground potential and providing a second voltage dividing output;

a second inverting amplifier coupled to receive the second voltage dividing output and providing a second inverting amplifier output; and a p-type insulated gate field effect transistor (IGFET) providing a controllable impedance path between the internal voltage supply line and the ground potential and having a control gate coupled to receive the second inverting amplifier output.

12. The voltage step-down circuit according to claim 1, wherein:

the compensation current source portion includes a voltage dividing circuit connected between the internal voltage supply line and a ground potential and providing a voltage dividing output;

an inverting amplifier coupled to receive the voltage dividing output and providing an inverting amplifier output; and a p-type insulated gate field effect transistor (IGFET) providing a controllable impedance path between the internal voltage supply line and the ground potential and having a control gate coupled to receive the inverting amplifier output.

13. The voltage step-down circuit according to claim 12, wherein:

the inverting amplifier includes a first p-type IGFET having a source coupled to the internal voltage supply line, and a drain coupled to the inverting amplifier output, and a gate coupled to receive the voltage dividing output; and a second p-type IGFET having a source coupled to the inverting amplifier output and a drain and a gate coupled to the ground potential.

14. The voltage step-down circuit according to claim 13, wherein:

the voltage dividing circuit provides the voltage dividing output at a potential close to a threshold voltage of a p-type IGFET below the internal voltage.

15. A voltage step-down circuit, comprising:

a voltage step-down portion comparing a reference voltage with an internal voltage and generating the internal voltage by reducing an external power source voltage in accordance with a comparison result;

an internal voltage supply line coupled to receive the internal voltage and providing power to an internal circuit having an active state and an inactive state;

the voltage step-down portion including a differential amplifier coupled to receive the reference voltage at a first input terminal and the internal voltage at a second input terminal and providing the comparison result;

an amplifier coupled to receive the comparison result and providing an amplifier output and power to the amplifier is provided by the internal voltage supply line; and a driver transistor that provides a current path for an output current between the external power source voltage and the internal voltage supply line and having a driver transistor control terminal coupled to receive the amplifier output wherein the amplifier that provides a compensation current for compensating the output current of the voltage step-down portion at a time when the internal circuit is in the inactive state.

16. The voltage step-down circuit according to claim 15, wherein:

the driver transistor is a p-type insulated gate field effect transistor (IGFET) having a driver transistor source coupled to receive the external power source voltage and a driver transistor drain coupled to the internal voltage supply line.

17. The voltage step-down circuit according to claim 15, wherein:

the amplifier includes a p-type insulated gate field effect transistor (IGFET) having a source coupled to the internal voltage supply line, a gate coupled to receive the comparison result, and a drain coupled to the amplifier output; and a n-type IGFET having a source coupled to the ground potential, a drain coupled to the amplifier output, and a gate coupled to receive the comparison result.

18. The voltage step-down circuit according to claim 15, wherein:

the amplifier includes a p-type insulated gate field effect transistor (IGFET) having a source coupled to the internal voltage supply line a gate coupled to receive the comparison result and a drain coupled to provide the amplifier output; and a n-type load IGFET having a source coupled to the ground potential a drain coupled to the amplifier output.

19. The voltage step-down circuit according to claim 15, wherein:

the amplifier includes a p-type load insulated gate field effect transistor (IGFET) having a source coupled to the internal voltage supply line and a drain coupled to the amplifier output; and a n-type IGFET having a source coupled to the ground potential, a drain coupled to the amplifier output, and a gate coupled to receive the comparison result.

20. A voltage step-down circuit, comprising:

a voltage step-down portion generating an internal voltage by reducing an external power source voltage in accordance with a comparison result;

an internal voltage supply line coupled to receive the internal voltage and providing power to an internal circuit having an active state and an inactive state;

the voltage step-down portion including a voltage dividing circuit providing a voltage dividing output by dividing the internal voltage;

a differential amplifier coupled to receive the reference voltage at a first input terminal and the voltage dividing output at a second input terminal and providing the comparison result;

an amplifier coupled to receive the comparison result and providing an amplifier output and power to the amplifier is provided by the internal voltage supply line; and a driver transistor providing a current path for an output current between the external power source voltage and the internal voltage supply line and having a driver transistor control terminal coupled to receive the amplifier output wherein the voltage dividing circuit, the differential amplifier, and the amplifier providing a compensation current for compensating the output current of the voltage step-down portion at a time when the internal circuit is in the inactive state.

21. The voltage step-down circuit according to claim 20, wherein:

the driver transistor is a p-type insulated gate field effect transistor (IGFET) having a driver transistor source coupled to receive the external power source voltage and a driver transistor drain coupled to the internal voltage supply line.

22. The voltage step-down circuit according to claim 20, wherein:

the amplifier includes a p-type insulated gate field effect transistor (IGFET) having a source coupled to the internal voltage supply line, a gate coupled to receive the comparison result, and a drain coupled to the amplifier output; and a n-type IGFET having a source coupled to the ground potential, a drain coupled to the amplifier output, and a gate coupled to receive the comparison result.

23. The voltage step-down circuit according to claim 20, wherein:

the amplifier includes a p-type insulated gate field effect transistor (IGFET) having a source coupled to the internal voltage supply line a gate coupled to receive the comparison result and a drain coupled to provide the amplifier output; and a n-type load IGFET having a source coupled to the ground potential a drain coupled to the amplifier output.

24. The voltage step-down circuit according to claim 20, wherein:

the amplifier includes a p-type load insulated gate field effect transistor (IGFET) having a source coupled to the internal voltage supply line and a drain coupled to the amplifier output; and a n-type IGFET having a source coupled to the ground potential, a drain coupled to the amplifier output, and a gate coupled to receive the comparison result.

25. A voltage step-down circuit, comprising:

a voltage step-down portion comparing a reference voltage with an internal voltage and generating the internal voltage by reducing an external power source voltage in accordance with a comparison result;

an internal voltage supply line coupled to receive the internal voltage and providing power to an internal circuit having an active state and an inactive state; and a functional circuit coupled to receive power from the internal voltage supply line and providing a compensation current for compensating an output current of the voltage step-down portion at a time when the internal circuit is in the inactive state.

26. The voltage step-down circuit according to claim 25, wherein:

the voltage step-down portion includes a differential amplifier coupled to receive the reference voltage at a first input terminal and the internal voltage at a second input terminal and providing the comparison result; and a driver transistor providing a current path for the output current between the external power source voltage and the internal voltage supply line and having a driver transistor control terminal coupled to receive the comparison result.

27. The voltage step-down circuit according to claim 26, wherein:

the driver transistor is a p-type insulated gate field effect transistor (IGFET) having a driver transistor source coupled to receive the external power source voltage and a driver transistor drain coupled to the internal voltage supply line.

28. A voltage step-down circuit, comprising:

a voltage step-down portion comparing a reference voltage with an internal voltage and generating the internal voltage by reducing an external power source voltage in accordance with a comparison result; and an internal voltage supply line coupled to receive the internal voltage and providing power to an internal circuit having an active state and an inactive state wherein a device parameter of the internal circuit is set so that an internal circuit leakage current consumed from the internal voltage supply line is at least a predetermined value at a time when the internal circuit is in the inactive state.

29. The voltage step-down circuit according to claim 28, wherein:

the voltage step-down portion includes a differential amplifier coupled to receive the reference voltage at a first input terminal and the internal voltage at a second input terminal and providing the comparison result; and a driver transistor providing an output current path between the external power source voltage and the internal voltage supply line and having a driver transistor control terminal coupled to receive the comparison result.

30. The voltage step-down circuit according to claim 29, wherein:

the driver transistor is a p-type insulated gate field effect transistor (IGFET) having a driver transistor source coupled to receive the external power source voltage and a driver transistor drain coupled to the internal voltage supply line.

* * * * *